US007606379B2

(12) United States Patent
Ivey et al.

(10) Patent No.: US 7,606,379 B2
(45) Date of Patent: Oct. 20, 2009

(54) OMNI-DIRECTIONAL SPEAKER LAMP

(75) Inventors: Lloyd Ivey, Ennis, TX (US); Paul Schleipfer, Scottsdale, AZ (US); Simon Broadley, Portland, OR (US)

(73) Assignee: Mitek Corp, Inc., Phoenix, AZ (US)

( * ) Notice: Subject to any disclaimer, the term of this patent is extended or adjusted under 35 U.S.C. 154(b) by 0 days.

(21) Appl. No.: 12/324,832

(22) Filed: Nov. 26, 2008

(65) Prior Publication Data

US 2009/0067663 A1 Mar. 12, 2009

Related U.S. Application Data

(63) Continuation-in-part of application No. 11/378,747, filed on Mar. 17, 2006, now abandoned.

(60) Provisional application No. 60/990,289, filed on Nov. 26, 2007, provisional application No. 61/081,870, filed on Jul. 18, 2008.

(51) Int. Cl.
*H04R 25/00* (2006.01)
*H04R 1/02* (2006.01)
*H04R 9/06* (2006.01)

(52) U.S. Cl. ..... 381/160; 381/333; 381/388; D14/224

(58) Field of Classification Search ..... 381/332, 381/333, 335, 337, 160, 374, 386, 388, 423, 381/397; 181/156, 173, 201; 362/86; D14/172, D14/204–216, 221, 224
See application file for complete search history.

(56) References Cited

U.S. PATENT DOCUMENTS

D127,950 S * 6/1941 Rockola ..... D14/213
2,501,968 A 3/1950 Sassin
3,170,538 A 2/1965 Detrick
3,184,586 A 5/1965 Hammes et al.
3,194,952 A 7/1965 Wells
3,500,953 A 3/1970 Lahti
3,816,672 A 6/1974 Gefvert et al.
5,980,057 A 11/1999 Christie
5,995,634 A * 11/1999 Zwolski ..... 381/160
D537,073 S * 2/2007 Peersman ..... D14/216
2005/0078837 A1 4/2005 Hornback

FOREIGN PATENT DOCUMENTS

JP 61065092 A 4/1986

* cited by examiner

*Primary Examiner*—Curtis Kuntz
*Assistant Examiner*—Jesse A Elbin
(74) *Attorney, Agent, or Firm*—Keith L. Jenkins, Registered Patent Attorney, LLC

(57) ABSTRACT

A speaker, having a diaphragm with a central opening and further having a pole piece, including a first sound dispersion element extending from the pole piece through the central opening of the diaphragm and further extending beyond the diaphragm wherein the first sound dispersion element has a larger transverse perimeter distal the pole piece than proximal the pole piece; and no support structures for the first sound dispersion element are located radially external to said first sound dispersion element. The speaker may be integrated with a lamp using a support structure. A second sound dispersion element may be used. A rod, used as a conduit, coupling, and/or support, may extend coaxially with the first sound dispersion element, interior thereto, and to a point beyond the diaphragm. The audio signal for the speaker may be supplied by a wireless link. The speaker and lamp may be configured for a ceiling fan.

20 Claims, 15 Drawing Sheets

OMNI-DIRECTIONAL SPEAKER LAMP

RELATED APPLICATIONS

This application is a continuation in-part application. It is a continuation-in-part of U.S. utility patent application Ser. No. 11/383,747 filed May 16, 2006 with one common inventor. This continuation-in-part application also claims the benefit of provisional patent application 60/990,289 filed Nov. 26, 2007 with one common inventor. This continuation-in-part application also claims the benefit of provisional patent application 61/081,870 filed Jul. 18, 2008 with all common inventors.

FIELD OF THE INVENTION

The present invention relates to loudspeaker that is operable to disperse sound in a 360° arc without physical obstructions placed within that arc. The present invention further relates to the use of the omni-directional speaker in a lamp and/or other electrical appliance. The present invention particularly relates to the use of the omni-directional speaker lamp that is attachable to a ceiling fan or similar environmental surface.

BACKGROUND OF THE INVENTION

A loudspeaker, or "speaker", as used herein, may use a moveable, baseless, approximately conical diaphragm to produce sound. Some diaphragms have radially symmetrical curvature or other shape variations (some are almost flat) that vary the geometry of the diaphragm from a strict geometric cone. The term "approximately conical," as used and defined herein, is intended to encompass such variations. The diaphragm is moved by a voice coil, which is attached to the diaphragm near the center of the base, or near the apex of a conical diaphragm. The voice coil, which rests in the magnetic field of a magnet assembly, receives an audio-encoded electrical signal, or "audio signal", which causes varying current in the voice coil and, by interaction of the voice coil current with the magnetic field of the magnet assembly, resultant sound-producing movement of the diaphragm. The voice coil is constrained to one-dimensional motion, perpendicular to the base plane of the diaphragm, by a flexible support structure called a "spider." The magnet assembly may comprise a magnetically permeable pole piece, a permanent magnet, and a magnetically permeable top plate. The pole piece may feature an annular groove, or "air gap," to permit motion of the voice coil deeper into the magnetic field of the magnet assembly. The diaphragm is supported at its base perimeter by a flexible suspension, or "surround", which, in turn, is supported by a structure called a "basket." The top plate of the magnet assembly and the spider are also connected to the basket. The opening of the diaphragm at the center is often covered with a dust cap, which reduces the amount of dust that may affect voice coil motion in the annular groove.

A theoretical omni-directional speaker disperses sound, ideally in a 360° arc. Expressed in solid angle terms, the ideal direct sound dispersion for an omni-directional speaker is $2\pi$ steradians. Thus, "omni-directional" is a technical misnomer, but is in common use in the industry. The arc is often oriented horizontally, in order to fill a room with sound. Many current omni-directional speakers have a sound dispersion element, often a cone pointed toward the speaker, suspended above the vertically oriented speaker. The cone changes the sound path from moving coaxially with the diaphragm to moving radially outward from the cone or other dispersion element. Struts, legs, fins, or other supports in the sound path are used to provide mechanical support for the inverted-cone dispersion element. Such mechanical supports are required to maintain the sound dispersion element in a proper orientation and spaced apart relationship relative to the speaker. These mechanical supports in the sound path interfere with sound waves traveling away from the dispersion element and so prevent complete 360° sound dispersion.

Prior attempts to combine speakers with lamps have failed to provide an unobstructed 360° arc of sound. In placing an appliance above a horizontally oriented omni-directional speaker, wires may be routed through the mechanical supports used for the dispersion element. This may require a mechanical support of larger cross-sectional dimension and so interfere with sound dispersion even more than would occur without the appliance wiring. Routing the wire over a long distance to avoid sound obstruction is also undesirable.

The integration of audio components into or onto existing electrical appliances, such as ceiling fans, presents a space-saving opportunity. Ceiling fans are often located centrally in a room, making them ideal locations for an omni-directional speaker. Some ceiling fans, as commercially manufactured, have adaptations for attaching light fixtures on the fan body below the fan blades such that the attached light fixture does not rotate with the fan blades.

Hence, there is a need for an omni-directional speaker that has no physical obstructions in the path of the sound leaving the sound dispersion element. There is also a need for an apparatus to assist in routing electrical power wires past an omni-directional speaker in a way that does not create or exacerbate physical obstructions in the sound path. There is also a need for an omni-directional speaker lamp having no obstructions in the sound path. There is also a need for an omni-directional speaker, optionally with a lamp, that is attachable to a ceiling fan, in the same fashion as lamps alone are attached to ceiling fans. The present invention addresses these needs.

BRIEF SUMMARY OF THE INVENTION

A speaker, having a diaphragm with a central opening and further having a pole piece, the speaker including: a first sound dispersion element extending from the pole piece through the central opening of the diaphragm and further extending beyond the diaphragm; and a rod coupled to the pole piece and extending, within the sound dispersion element, through the central opening of the diaphragm to a point beyond at least a portion of the diaphragm, where the rod is able to at least assist in supporting an object, other than the first sound dispersion element, adjacent the point beyond the diaphragm. The object includes a second sound dispersion element and the second sound dispersion element abuts to and/or extends from the first sound dispersion element. The object may include an IR receiver; a light socket; an LED display; and/or at least a portion of a wireless audio receiver. The speaker includes a support structure adapted to support the speaker in a spaced-apart relationship with an environmental surface or a ceiling fan. The speaker integrated into an omni-directional speaker lamp; an inverted omni-directional speaker lamp; a wireless omni-directional speaker lamp; a wireless omni-directional speaker lamp adapted to be coupled to a ceiling fan; or a compact omni-directional speaker lamp. The speaker where the first sound dispersion element includes a larger transverse perimeter distal the pole piece than proximal the pole piece. The first sound dispersion element is able to disperse sound unobstructed by structural members located radially external to the first sound dispersion element. The pole piece includes an axial threaded bore and the rod includes externally threads and at least one longitudinal bore and is secured in the axial threaded bore, the externally threaded rod is able to serve as at least a portion of a coupling able to receive a securer able to secure the first sound dispersion element to the pole piece; at least a portion of a coupling able to secure and support an electrical light socket or a circuit board in a spaced-apart relationship with the pole piece; and a conduit for an electrical power conductor. The speaker further includes a wireless audio signal receiver.

A speaker having a diaphragm having an axis of radial symmetry, a central opening, and a pole piece proximate the central opening, the pole piece having a bore there through, where the bore is axially aligned to the central opening in the diaphragm, the speaker further including: a first sound dispersion element extending from proximate the pole piece through the central opening of the diaphragm, where the first sound dispersion element has a proximal end proximate to the pole piece and a distal end distal to the pole piece, and where the first sound dispersion element includes a web defined by a longitudinal axis aligned parallel to the axis of radial symmetry of the diaphragm, the web including a larger transverse perimeter at the distal end and including a smaller transverse perimeter at the proximal end; the first sound dispersion element able to create a sound path generally transverse to the axis of radial symmetry of the diaphragm in an arc of 360 degrees; where the first sound dispersion element is able to disperse sound unobstructed by structural members located radially external to the first sound dispersion element; and a rod coupled to the pole piece and extending, within the first sound dispersion element, through the central opening of the diaphragm to a point beyond the diaphragm, where the rod is able to at least assist in supporting an object, other than the first sound dispersion element, at a point beyond the diaphragm. The object includes an IR receiver, a light socket, an LED display, and/or at least a portion of a wireless audio receiver. The dispersion element supports a cover for an IR receiver, an LED display, and/or at least a portion of a wireless audio receiver. The speaker has a housing, including one or more couplings for coupling the speaker to an environmental surface or a ceiling fan. The coupling is further able to be coupled to a bracket on an environmental surface. The housing further includes a housing for an audio power supply, an audio amplifier, a micro controller, a digital signal processor, and a dimmer circuit. The housing further includes a housing for at least a portion of a wireless audio receiver. The speaker further includes an electrical light socket structured and arranged to be secured to the rod or to the housing. The object may be a second sound dispersion element, where the second sound dispersion element abuts to and/or extends from the first sound dispersion element. The speaker may include a ceiling fan that is either coupled to or integrated with the speaker.

A speaker, having a diaphragm with a central opening and a pole piece having an axial threaded bore through the pole piece, the speaker further including: a first sound dispersion element extending from the pole piece through the central opening of the diaphragm and further extending beyond the diaphragm; where the first sound dispersion element includes a web having a larger transverse perimeter distal the pole piece than proximal the pole piece and further includes a internal transverse flange proximate the pole piece; an externally threaded rod threaded partially into the axial threaded bore and extending within the web and further extending to a point beyond the diaphragm; an electrical device coupled to the externally threaded rod distal said pole piece; a support structure structured and arranged to support the speaker in a particular orientation; a support member configured to support the speaker in a spaced apart relation to an environmental surface or a ceiling fan; an audio signal receiver structured and arranged to supply an audio signal to the speaker; an electrical power wire structured and arranged to supply electrical current to the electrical device; and a remotely controllable electrical switch structured and arranged to control the supply of electrical current to the electrical device and to the supply of audio signal to the speaker.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
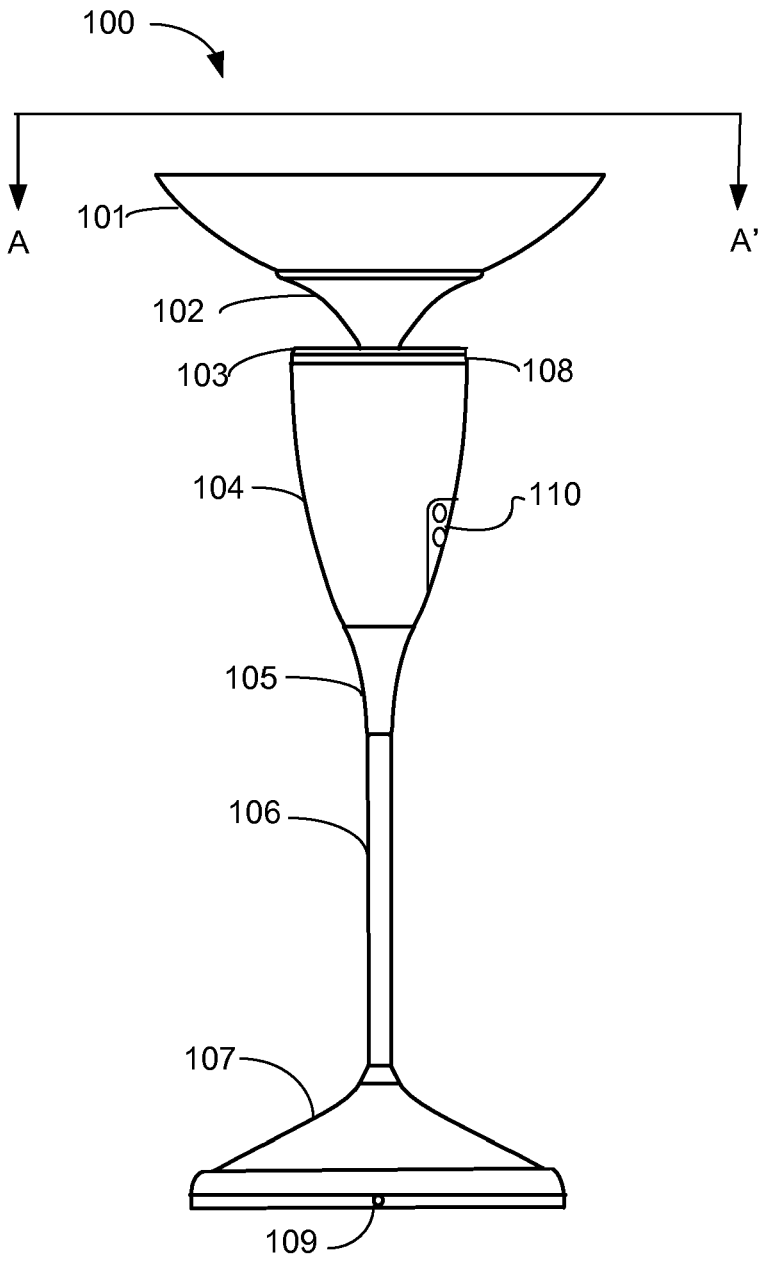
FIG. 1 is a side view of an exemplary embodiment of the omni-directional speaker lamp configured as a floor lamp.

FIG. 1 is a side view of an exemplary embodiment of the omni-directional speaker lamp 100 configured as a floor lamp. The surround 103 of the speaker 203 (see FIG. 2) is shown extending slightly above the rim of the basket 108, about which, more will be discussed in relation to FIG. 3. Thus, the speaker 203 is pointed upward in the view of FIG. 1. Support structure, or housing, 104 supports basket 108 by the rim thereof. The support structure 104 is preferably a rotationally symmetric web, as shown. In various other embodiments, the support structure 104 may be of any design that serves the functional purpose of supporting the basket 108. In addition to the speaker 203, support structure 104 may also house other components of the apparatus, as will be discussed below. Those skilled in the art, upon reading the teachings of this specification, will appreciate that, under appropriate circumstances, considering such issues as system integration requirements, the operational environment, ergonomics, and customer preferences, other omni-directional speaker lamp 100 configurations, such as shorter, longer, wider, having a different profile, etc., may suffice.

The first sound dispersion element 102 extends through the center of the speaker 203 (see FIGS. 2 and 3) and abuts the second sound dispersion element 101, as shown. The transverse perimeter of first sound dispersion element 102 increases as a function of distance from the speaker 203, as shown. Preferably, the first sound dispersion element 102 has a double-elliptical profile. The outer radius of first sound dispersion element 102 is preferably at least equal to the outer radius of speaker 203. The radius of second sound dispersion element 101 is preferably greater than the radius of speaker 203. First sound dispersion element 102 is preferably made of aluminum, but any material suitable for reflecting sound 330 (see FIG. 3) will suffice. In some alternate embodiments, first sound dispersion element 102 may be made of more than one material. Second sound dispersion element 101 may also serve as a lampshade, as will be discussed in more detail in regard to FIG. 2. In some alternate embodiments, there may be more than one second sound dispersion element 101. For example, without limitation, first sound dispersion element 102 may extend from the center of the speaker 203, second sound dispersion element 101 may abut to and extend from first sound dispersion element 102, and a third sound dispersion element (not shown) may abut to and extend from second sound dispersion element 101. While the first and second sound dispersion units 102 and 101 are illustrated as radially symmetrical, that is not a requirement. In some particular embodiments, asymmetry may be desired. In some particular embodiments, first sound dispersion element 102 and second sound dispersion element 101 may comprise a single piece. Those skilled in the art, upon reading the teachings of this specification, will appreciate that, under appropriate circumstances, considering such issues as system integration requirements, the operational environment, ergonomics, and customer preferences, other first sound dispersion element 102 configurations, such as conic, exponential, logarithmic, sinusoidal, etc., may suffice.

Optional transition piece 105 provides an aesthetically pleasing transition between support structure 104 and the vertical support member 106. In some embodiments, transition piece 105 may be omitted, and the support structure 104, transition piece 105, and vertical support member 106 may be a single piece. Vertical support member 106 maintains speaker 203 in a spaced-apart relationship with a floor, or similar horizontal surface. In some embodiments, vertical support member 106 may be adjustable in length. Foot 107, which is coupled to and supports vertical support member 106, provides structural support for the entire apparatus 101-106, as shown. Foot 107 is preferably a gracefully sloping structure. In alternate embodiments, foot 107 may be of any design suitable to the function of supporting the apparatus 101-106. Foot 107 may have an opening 109, as shown, to accommodate electrical power wires 205 (see FIG. 2) and/or audio signal wires 204 (see FIG. 2). In a particular alternate embodiment, the electrical power may come from a battery within foot 107 or support structure 104, and/or the audio signal may arrive by wireless link. Section A-A' defines a sectional view provided in FIG. 2. Control panel 110 may provide manual controls for volume, lamp brightness, audio signal source selection, and auxiliary audio jacks for audio input and output. Those skilled in the art, upon reading the teachings of this specification, will appreciate that, under appropriate circumstances, considering such issues as system integration requirements, the operational environment, ergonomics, availability of materials, and customer preferences, other structural arrangements, such as those having a single central pole to support all other parts, those using perforated webs for support structures, and those using decoratively varied shapes, etc., may suffice.

Figure 2:
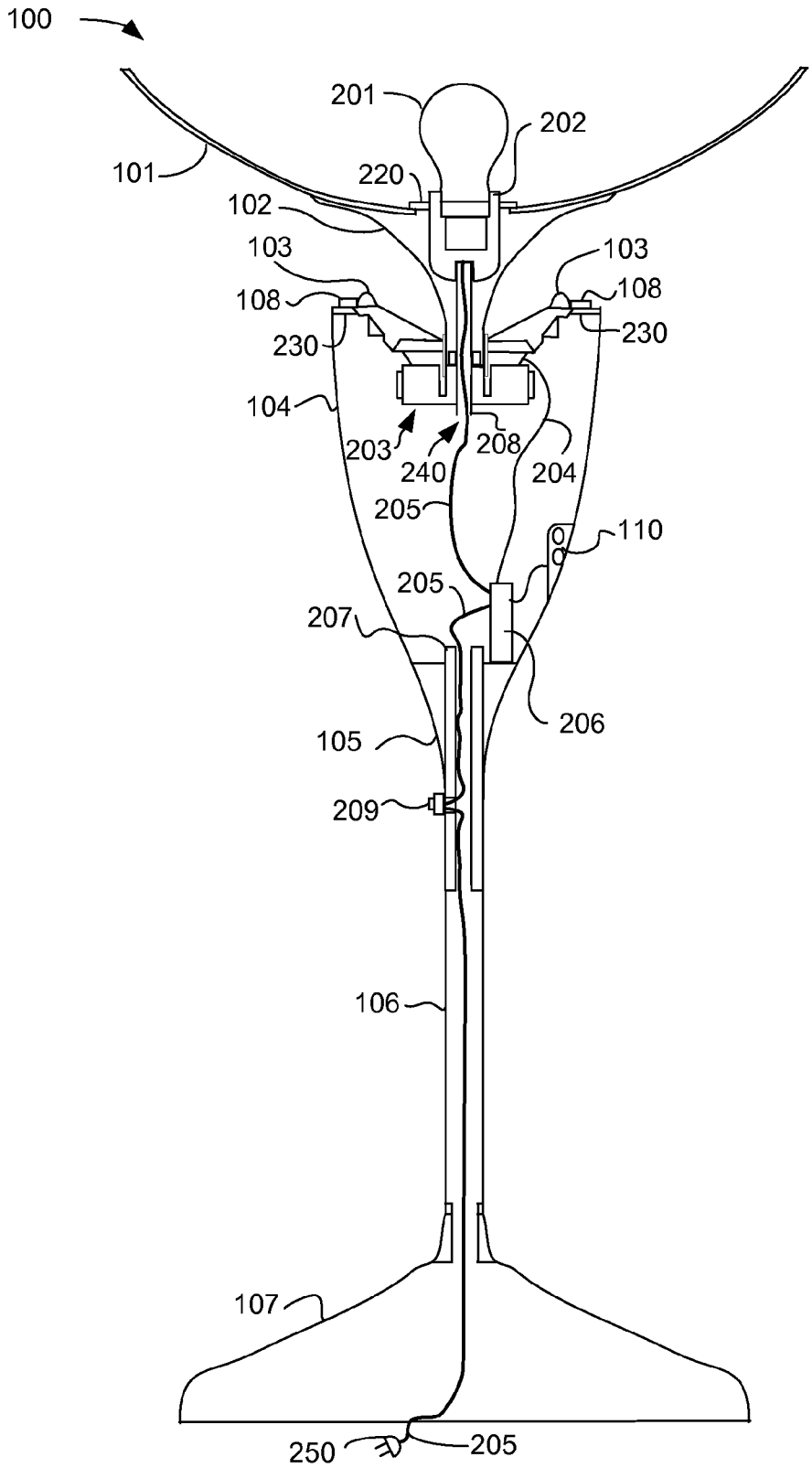
FIG. 2 is a side sectional view through section A-A' of FIG. 1 of the exemplary embodiment of the omni-directional speaker lamp of FIG. 1.

FIG. 2 is a side sectional view through section A-A' of FIG. 1 of the exemplary embodiment of the omni-directional speaker lamp 100 of FIG. 1. Speaker 203 is preferably resting by the rim of basket 108 on support flange 230, which is integral to support structure 104, as shown. Support flange 230 is preferably an annular flange 230, as shown. In alternate embodiments, support flange 230 may be segments of an annular support flange 230. While support flange 230 is shown as having a rectangular cross section, those of skill in the art will be aware of the variety of cross-sectional shapes which may be used to achieve the same purpose. Surround 103 is coupled to the basket 108 rim, as shown. Those skilled in the art, upon reading the teachings of this specification, will appreciate that, under appropriate circumstances, considering such issues as system integration requirements, the operational environment, ergonomics, availability of materials, and customer preferences, other couplings between basket 108 and support flange 230, such as couplings using various fasteners or releasable fasteners, couplings on support flanges 230 that adapt support structures 104 having non-circular transverse cross sections to hold circular speaker baskets 108, and couplings that are at least partially integral to support flange 230, etc., may suffice.

Rod 208 extends through the speaker 203 to secure and support electrical light socket 202, as shown. Rod 208 is preferably an externally threaded rod 208 and is preferably retained in position by threads in axial bore 350 (see FIG. 3) through pole piece 301 (see FIG. 3), as shown. Rod 208 is preferably threaded into the bottom of electrical light socket 202 to provide mechanical support to light bulb 201, as shown. Electrical light socket 202 is adapted to receive light bulb 201, as shown. Fixed flange 220 is preferably coupled to or integral with electrical light socket 202. Fixed flange 220 may be used to urge second sound dispersion element 101 into abutment with first sound dispersion element 102 by screwing electrical light socket 202 further down on rod 208, thereby to retain second sound dispersion element 101 in abutment with first sound dispersion element 102, as shown. Rod 208 may thus secure multiple objects, such as electrical light socket 202, or other appliance, and second sound dispersion element 101. In various alternative embodiments, rod 208 may support other objects as well or instead of those disclosed for this embodiment. Fixed flange 220 is preferably an annular flange 220. In various alternate embodiments, other fixed flange 220 arrangements, as are known to those of skill in the art, may be used. Those skilled in the art, upon reading the teachings of this specification, will appreciate that, under appropriate circumstances, considering such issues as system integration requirements, the operational environment, ergonomics, availability of materials, and customer preferences, other configurations for rod 208, such as threading only on portions of rod 208 that require threads, other methods of securing rod 208 within axial threaded bore 350, a rod 208 that extends for more or less of the length of the omni-directional speaker lamp 100, a rod 208 having a non-circular radial cross-section, and a rod 208 comprised of sections, etc., may suffice.

Second sound dispersion element 101 is preferably of a rigid material, such as glass, and is preferably configured to shade the eyes of an average person from directly viewing light bulb 201. Thus the second sound dispersion element 101 is preferably translucent and may be opaque in some alternate embodiments. In alternate embodiments using an opaque second sound dispersion element 101, the second sound dispersion element 101 may be made of metal. Rigid polymers may also be used to form second sound dispersion element 101. Second sound dispersion element 101 preferably has a shape that is functional for sound dispersion (as is known in the art of acoustics) and is also aesthetically pleasing. In some embodiments, second sound dispersion element 101 may be decorated by various means known for decorating lampshades. First sound dispersion element 102 is preferably a web with radial symmetry and extending from the pole piece 301 (see FIG. 3) to the second sound dispersion element 101, as shown. In a particular embodiment, first sound dispersion element 102 and second sound dispersion element 101 may be combined into a single sound dispersion element. In another particular embodiment, first sound dispersion element 102 and rod 208 may be an integral unit. Those skilled in the art, upon reading the teachings of this specification, will appreciate that, under appropriate circumstances, considering such issues as system integration requirements, the operational environment, ergonomics, availability of materials, and customer preferences, other first and second sound dispersion elements 102 and 101, such as having a different shape adapted to particular sound dispersion requirements, having both sound dispersion elements 102 and 101 made of translucent material, and first and second sound dispersion elements 102 and 101 adapted to differentially disperse different frequencies in different directions, etc., may suffice.

Electrical power wires 205 are preferably routed through a complete longitudinal bore 240 in rod 208, as shown. The electrical power wires 205 conduct electrical power to light bulb 201 via electrical light socket 202. Electrical power wires 205 may originate at conventional electrical plug 250 and are routed up through foot 107 and into vertical support member 106 to switch 209, as shown. Switch 209 is preferably a dimmer switch operable to turn the power on and off as well as dim the output of light bulb 201. Wireless audio signal receiver 206 may obtain power for its integral power supply from electrical power wires 205, which may be connected in parallel or series. In some alternate embodiments, power for the light bulb 201 and the wireless audio signal receiver 206 are independently provided. In particular embodiments requiring no external wires, the power may come from electrical energy stored in batteries, ultra capacitors, or the like. The electrical storage components may be located inside the foot 107 or the support structure 104, for example. Speaker wires 204 may, in particular embodiments, lead directly to an external audio source with no wireless link involved. In yet another particular embodiment, the use of the wireless audio signal receiver 206 may be made optional by the provision of an audio jack (not shown) into the speaker wires 204. The insertion of an audio plug into the audio jack may turn off the wireless audio signal receiver 206. In a particular embodiment, switch 209 may control only the power to light bulb 201, while a separate power line (not shown) for the wireless audio signal receiver 206 would have a separate switch (not shown). The location of switch 209 is notional: the switch 209 may be located in any convenient spot. In a particular exemplary embodiment 1700, switching, brightness, and/or volume control may optionally be by wireless remote control.

Those skilled in the art, upon reading the teachings of this specification, will appreciate that, under appropriate circumstances, considering such issues as system integration requirements, the operational environment, ergonomics, availability of materials, and customer preferences, other approaches to providing power to the light bulb 201, such as by direct current supply, batteries, photovoltaic cells with battery storage, or adaptations to various or multiple international commercial power parameters, etc., may suffice. Likewise, other approaches to supplying an audio signal to speaker 203, such as from a source (CD player, radio, iPod, etc.) integral to the omni-directional speaker lamp 100, as well as various approaches to supplying an audio signal from outside the omni-directional speaker lamp 100, etc, may suffice.

Connector 207, which may be an externally threaded tube, is used to connect the support structure 104, transitional section 105 and the vertical support member 106, as shown. Connector 207 may also provide an opening for switch 209, as shown. In various embodiments, other connectors 207, singly or separately, which perform the same function, may be used. Rod 208 may connect to (or abut) connector 207 for additional structural support.

Figure 3:
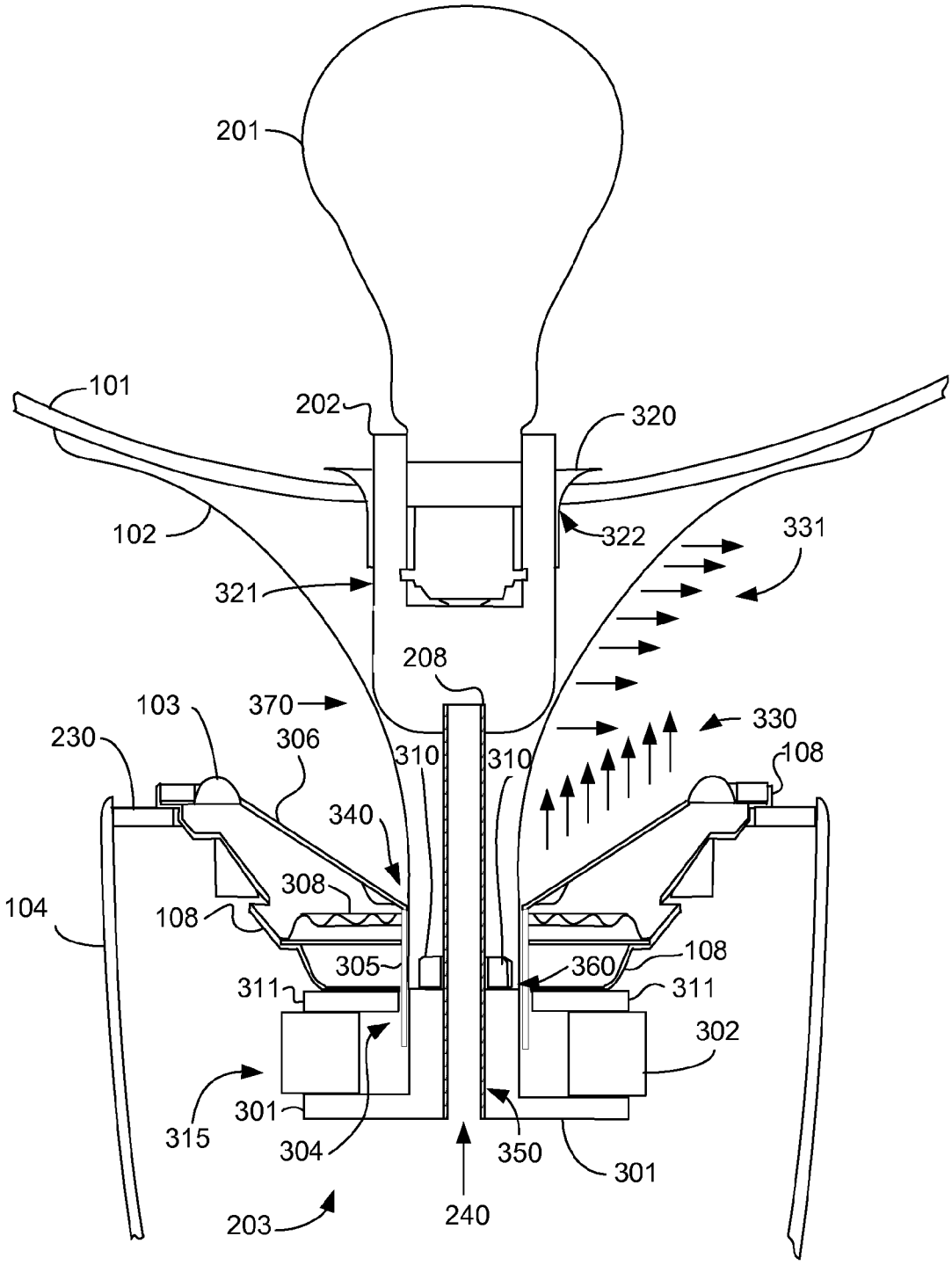
FIG. 3 is a truncated and enlarged sectional view through section A-A' of the embodiment of the omni-directional speaker lamp of FIG. 1 showing details of the connection between the speaker and the first sound dispersion element.

FIG. 3 is a truncated and enlarged sectional view through section A-A' of the embodiment of the omni-directional speaker lamp 100 of FIG. 1 showing details of the connection between the speaker 203 and the first sound dispersion element 102. Magnet assembly 315 includes pole piece 301 wrapped with permanent magnet 302, as shown, creating a magnetic field within and between the pole piece 301 and top plate 311. Top plate 311 is an annular plate of magnetically permeable material that covers most of the top of permanent magnet 302. Pole piece 301 is configured in relationship to permanent magnet 302 and top plate 311 to create air gap 304 for enabling motion of the voice coil 305. Pole piece 301 has an axial bore 350 into which rod 208 has been inserted, as shown. Preferably, axial threaded bore 350 and rod 208 have complimentary threads, allowing rod 208 to be threaded into axial bore 350, as shown. Rod 208 preferably has a complete longitudinal bore 240, as shown. Rod 208 is also defined and referred to herein to be a "support" and, with longitudinal bore 240, is also defined and referred to herein to be a "tube" or "conduit." In various other embodiments, various other methods for retaining a rod 208 in an axial bore 350, as are known in the art, may be used. Those skilled in the art, upon reading the teachings of this specification, will appreciate that, under appropriate circumstances, considering such issues as commercial-off-the-shelf speaker configurations, acoustic optimization, availability of materials, and customer preferences, other approaches to providing a magnet assembly 315 having a coaxial rod 208 extending there from, such as a rod 208 formed integrally with the magnet assembly 315, providing a rod 208 with multiple longitudinal bores 240, or multiple rods 208 through multiple axial threaded bores 350, etc., may suffice.

Approximately conical diaphragm 306 has a central opening 340 at the center of the diaphragm through which the first sound dispersion element 102 extends through the diaphragm 306 and extends beyond diaphragm 306, as shown. Rod 208 coaxially extends within the first sound dispersion element 102 to a point 370 beyond the diaphragm 306, as shown. Point 370 may lie within the first sound dispersion element 102 or, in other embodiments, may extend beyond the distal end of first sound dispersion element 102. In conventional commercial-off-the-shelf speakers, central opening 340 may be closed with a dust cover. Using the pole piece 301 to support both the first sound dispersion element 102 and the rod 208 obviates the need for legs or supports in the sound path 331 to support the first sound dispersion element 102, the electrical light socket 202, or the second sound dispersion element 101, as shown. While the combination of the speaker 203, rod 208, and first and second sound dispersion elements 102 and 101 preferably operates without support structures in the 360° (about axis 402) sound path 331, in a particular embodiment, decorative structures may be tolerated.

Securer 310 may be threaded on rod 208 to engage a flange 404 (see FIG. 4) of the first sound dispersion element 102 to couple the flange 404 (see FIG. 4) to the pole piece 301, as shown. By securing the first sound dispersion element 102 in this manner, sound 330 created by the diaphragm 306 can reflect off first sound dispersion element 102 and disperse along a path 331 out of the apparatus unobstructed by any support members, as shown, for hypothetical example, from support structure 104 and the first sound dispersion element 102. The rod 208 and the securer 310 form a coupling 360 for releasably coupling flange 404 (see FIG. 4) of first sound dispersion element 102 to pole piece 301, as shown. The coupling 360 may, in some alternate embodiments, include washers, lock washers, spacers, and the like. The sizing of the securer 310 and rod 208 should allow for wrench clearance between the securer 310 and the internal surface 611 (see FIG. 6) of the first sound dispersion element 102. In an alternate embodiment, opening 601 (see FIG. 6) formed by flange 404 may be internally threaded to make securer 310 integral to first sound dispersion element 102. While the combination of speaker 203 and a first sound dispersion element 102 is operable to disperse sound along 360° sound path 331 without obstruction, it may also be operated with decorative members obstructing or shaping the sound path 331.

Those of skill in the art, informed by this disclosure, will appreciate the various ways that first sound dispersion element 102 may be coupled to pole piece 301. For example, rod 208 may be made integral to first sound dispersion element 102, and the entire unit may be screwed into threaded axial bore 350. In various embodiments, the securer 310 may be replaced by a clip nut, push nut, or other type of securer or retaining device used for threaded or unthreaded rods, as is known in the art. In another alternate embodiment, the first sound dispersion element 102 may be coupled to the pole piece 301 with adhesives. What is essential is that the first sound dispersion element 102, which widens distally from the pole piece 301, extends from proximate pole piece 301.

Pole piece 301 has an air gap 304 to allow voice coil 305 one-dimensional (vertical, as viewed) freedom of motion in the magnetic field. Voice coil 305 is connected to diaphragm 306 and is supported by spider 308. Preferably, first sound dispersion element 102 has a constant radius for a vertical distance from the pole piece 301 adequate to allow the voice coil 305 complete freedom of vertical motion, as shown. Voice coil 305 moves parallel to the exterior surface of the constant-radius portion of the first sound dispersion element 102, so a constant radius 606 (see FIG. 6) is preferred, at least over the range of voice coil 305 motion, as shown. The relationship between pole piece 301, permanent magnet 302, and top plate 311 determines the strength and directionality of the magnetic field in the air gap 304 and through the voice coil 305, which, in turn, is a major factor in speaker 203 performance. Those of skill in the art, informed by this disclosure, will appreciate the importance of not modifying the magnetic assembly 315 in ways that noticeably modify the magnetic field through the voice coil 305.

Rod 208 couples to electrical light socket 202 and supports electrical light socket 202 in spaced-apart relation to the first sound dispersion element 102, as shown. The structural inclusion of the electrical light socket 202 creates a lamp. A flanged sleeve 320 is shown with a curved underside 322 useful for urging second sound dispersion element 101 into abutment with first sound dispersion element 102 with less vertical travel of the flanged sleeve 320 than with flat-surfaced fixed flange 220. Flanged sleeve 320 is vertically adjustable on the threaded surface 321 of electrical light socket 202 to secure second sound dispersion element 101 in abutment to first sound dispersion element 102. Second sound dispersion element 101 also serves, as mentioned earlier, as a lampshade. Light bulb 201 is inserted in electrical light socket 202 in the conventional way and, when electrical plug 250 is inserted in a live wall socket and switch 209 is turned on, light bulb 201 will produce light for the lamp. Those of skill in the art, enlightened by this disclosure, will recognize that a wide variety of electrical appliances may substitute for the electrical light socket 202 and light bulb 201. For example, without limitation, plasma display panels, light organs, laser light show projectors, and additional speakers 203 may be used in conjunction with the speaker 203.

Figure 4:
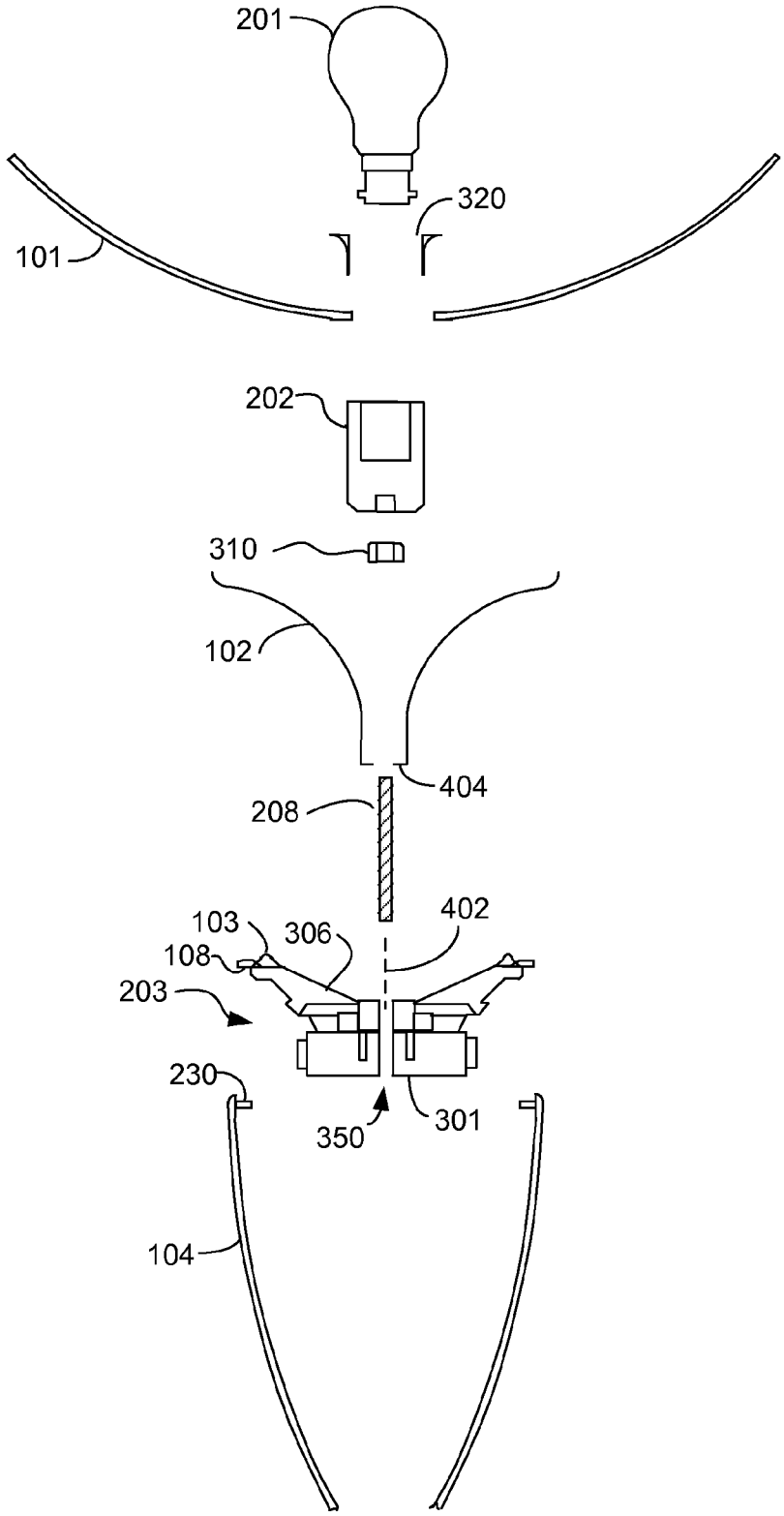
FIG. 4 is a partial assembly-sequence view of the exemplary embodiment of the omni-directional speaker lamp of FIG. 1.

FIG. 4 is a partial assembly-sequence view of the exemplary embodiment of the omni-directional speaker lamp 100 of FIG. 1. The assembly proceeds from bottom to top, as illustrated, with the parts aligning generally to the axis of radial symmetry 402 of the diaphragm 306 of speaker 203. Speaker 203 is lowered onto support flange 230 of support structure 104 so that the basket 108 contacts the support flange 230, as shown. Fasteners, as are known in the art, may be used to secure the basket 108 to the support flange 230. Rod 208 is preferably threaded into threaded axial bore 350, leaving a significant part of rod 208 still extending upward (in FIG. 4) out of pole piece 301, as shown. First sound dispersion element 102 is preferably lowered onto rod 208 such that flange 404 touches the pole piece 301 of speaker 203, as shown. Securer 310 is threaded along rod 208 to urge flange 404 against pole piece 301 and to retain flange 404 in that position, as shown. Electrical light socket 202 is threaded onto rod 208, as shown, (electrical power wires 205 (see FIG. 2) are connected first). Second sound dispersion element 101 is lowered over the electrical light socket 202 into abutment with first sound dispersion element 102, as shown. Flanged sleeve 320 is threaded onto electrical light socket 202 to retain second sound dispersion element 101 in abutment with first sound dispersion element 102, as shown. Light bulb 201 is inserted into the electrical light socket 202 for operation, but the omni-directional speaker lamp 100 will normally be sold without the light bulb 201 installed.

Figure 5:
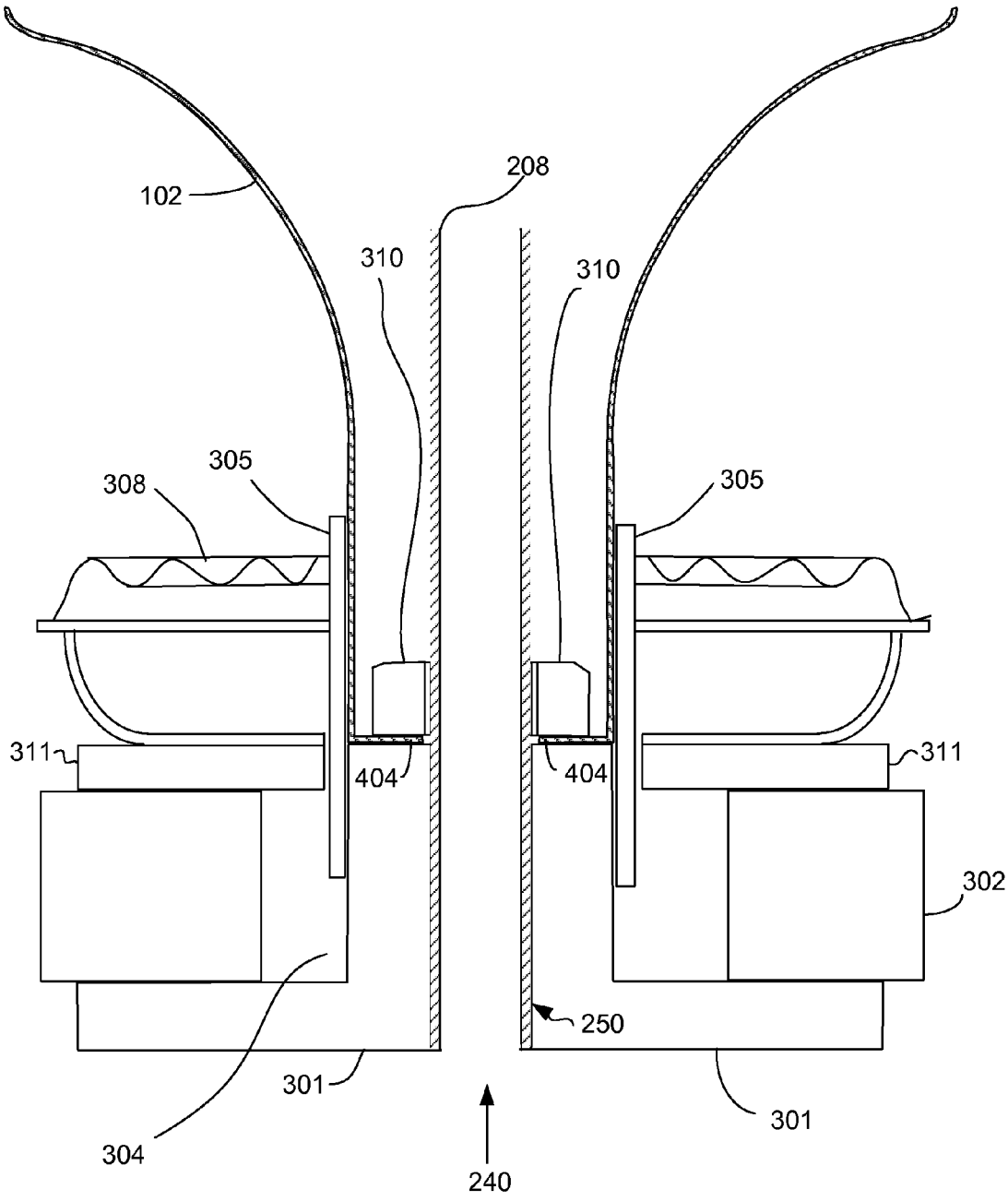
FIG. 5 is a truncated and enlarged sectional view through section A-A' of the embodiment of the omni-directional speaker lamp of FIG. 1 showing further details of the apparatus for fastening the first sound dispersion element to the pole piece.

FIG. 5 is a truncated and enlarged sectional view through section A-A' of the embodiment of the omni-directional speaker lamp 100 of FIG. 1 showing further details of the apparatus for fastening the first sound dispersion element 102 to the pole piece 301. It should be understood that the securer 310 is shown as a nut in cross section as two sides of the same nut, with the threaded bore of the nut receiving rod 208. As securer 310 is tightened downward (as viewed in this FIG. 5) flange 404 of first sound dispersion element 102 is urged against pole piece 301. In some embodiments, a lock washer may be used between securer 310 and internal transverse flange 404.

Figure 6A:
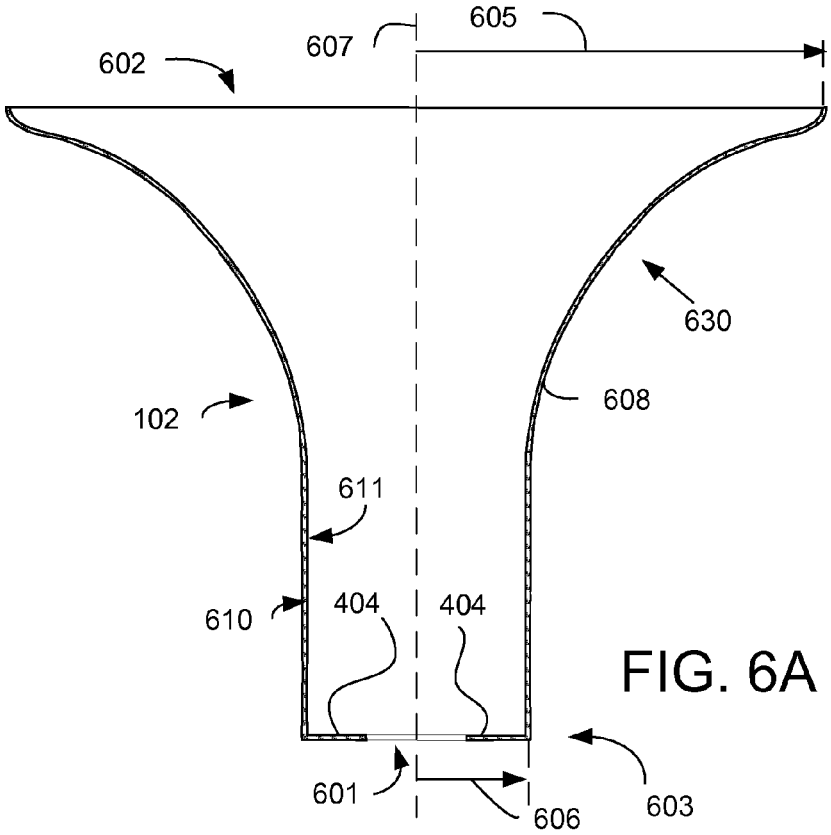
FIG. 6A is a side cutaway view illustrating the first sound dispersion element of the exemplary embodiment of the omni-directional speaker lamp of FIG. 1.
Figure 6B:
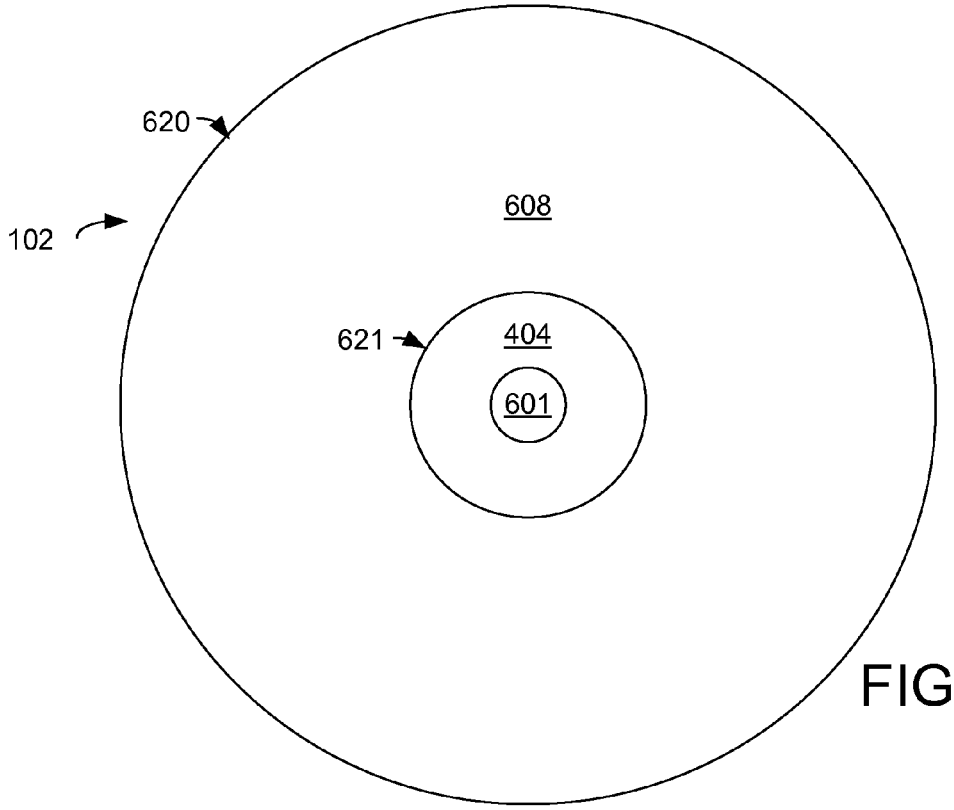
FIG. 6B is a plan view illustrating the first sound dispersion element of the exemplary embodiment of the omni-directional speaker lamp of FIG. 1.

FIG. 6A is a side cutaway view illustrating the first sound dispersion element 102 of the exemplary embodiment of the omni-directional speaker lamp 100 of FIG. 1. FIG. 6B is a plan view illustrating the first sound dispersion element 102 of the exemplary embodiment of the omni-directional speaker lamp 100 of FIG. 1. Web 608 and flange 404 make up first sound dispersion element 102, as shown. Flange 404 leaves an opening 601 for receiving rod 208 (see FIG. 2), as shown. Radius 606 is chosen, together with the thickness of web 608, to provide clearance with the voice coil 305, as shown. Radius 606 remains constant proximate the pole piece 301, as shown, to ensure that the voice coil 305 can move freely. Towards the distal end 602 of the first sound dispersion element 102, the radius 606 increases to radius 605 as shown. As the radius increases elliptically to radius 605, the transverse, or cross-sectional, perimeter of web 608 increases in accordance with $C=2\pi r$, where C=the perimeter, r=the radius, and $2\pi$ is a constant. While web 608 is shown as having radial symmetry about centerline 607, radial symmetry is not a requirement, nor is it required that the web 608 create surfaces of revolution. Irregular shapes for web 608 may be used (i.e., to create particular sound effects) subject to the requirement that the distal transverse perimeter 620 of the distal end 602 be larger than the proximal transverse perimeter 621 of the proximal end 603, as shown. Curvature 630 is preferably the result of a double elliptical curve of the external surface 610 of web 608. Other functions may be used, as mentioned above and below, to define the curvature 630 to produce various sound dispersions.

Figure 7:
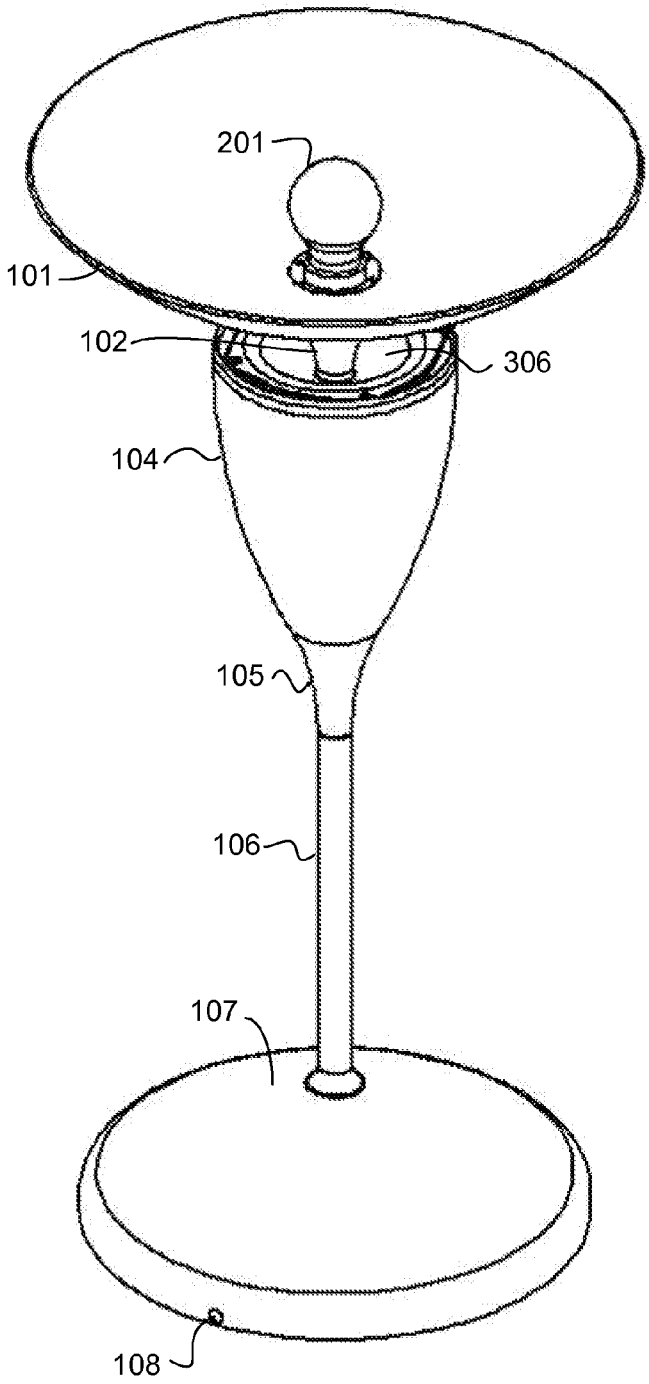
FIG. 7 is a perspective view illustrating the exemplary embodiment of the omni-directional speaker lamp of FIG. 1.

FIG. 7 is a perspective view illustrating the exemplary embodiment of the omni-directional speaker lamp 100 of FIG. 1. Those of skill in the art, informed by this disclosure, will appreciate the wide variation in aesthetic design of the first sound dispersion element 102, second sound dispersion element 101, and support structure 104 that may meet the functional requirements for this omni-directional speaker lamp 100. Various shapes of web 608 of first sound dispersion element 102 may be used, including, without limitation, cones, elliptical revolutions, parabolic revolutions, exponential revolutions, logarithmic revolutions, and ray trace surfaces adapted to achieve particular sound dispersion patterns. Likewise, second sound dispersion element 101 may have shapes different from that illustrated, as long as it is consistent with the functions of having a sound dispersing surface proximate the speaker 203 and a light dispersing surface proximate the light bulb 201. Support structure 104 may be of any shape that enables the functions of support and containment for the speaker 203 and associated parts.

Figure 8A:
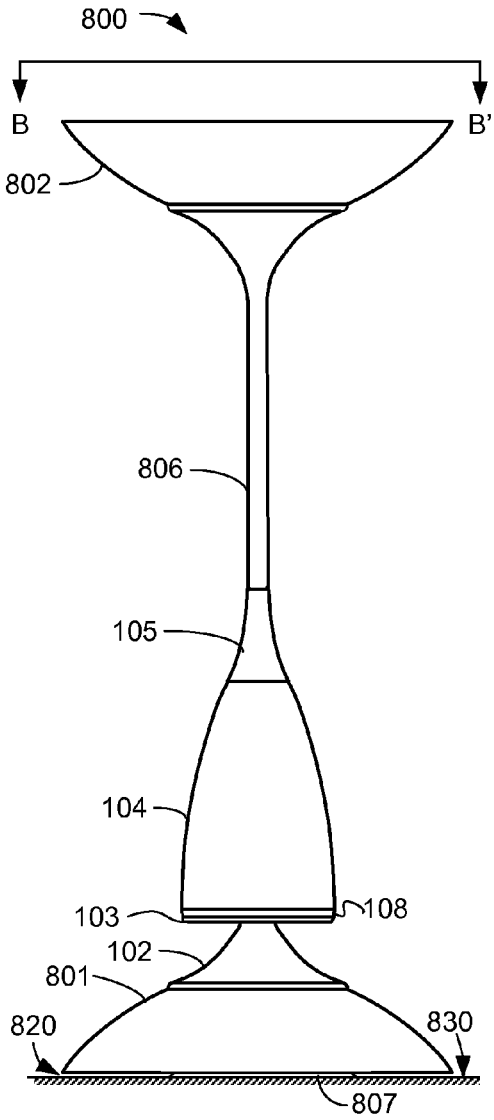
FIG. 8A is a side view illustrating a second exemplary embodiment of the omni-directional speaker lamp configured as an inverted omni-directional speaker lamp.

FIG. 8A is a side view of a second exemplary embodiment of the omni-directional speaker lamp, configured as an inverted omni-directional speaker lamp 800. Section B-B' defines a vertical section through the centerline of inverted omni-directional speaker lamp 800. Inverted omni-directional speaker lamp 800 has a first sound dispersion element 102 near the floor 830, or similar environmental surface, upon which inverted omni-directional speaker lamp 800 rests, as shown. Second sound dispersion element 801 abuts to and extends from first sound dispersion element 102, as shown. Second sound dispersion element 801 may be supported in place by a threaded flange 840 which is threaded on rod 208. Second sound dispersion element 801 may be kept off the floor 830 by an inner foot 807 which creates a gap 820 between the floor 830 and the second sound dispersion element 801, as shown. This prevents mechanical loading of the second sound dispersion element 801 which might cause changes in the sound-dispersion pattern due to deformation of second sound dispersion element 801 under load. Gap 820 also provides a path for electrical power wires 205 to reach a conventional power outlet. In an alternative embodiment wherein the second sound dispersion element 801 is made sufficiently strong to avoid deformation, inner foot 807 may be omitted. Surround 103 is coupled to support structure 104, as shown, which is further coupled to transition piece 105.

Lamp support pole 806 is coupled to transition piece 105 either directly or indirectly. Lamp support pole 806 supports lampshade 802. Those skilled in the art, upon reading the teachings of this specification, will appreciate that, under appropriate circumstances, considering such issues as operational environment, acoustic optimization, availability of materials, and customer preferences, other approaches to designing an inverted omni-directional speaker lamp 800, such as chandelier, candelabra, multiple, radially-deployed omni-directional speakers, radially-deployed omni-directional lights, etc., may suffice.

Figure 8B:
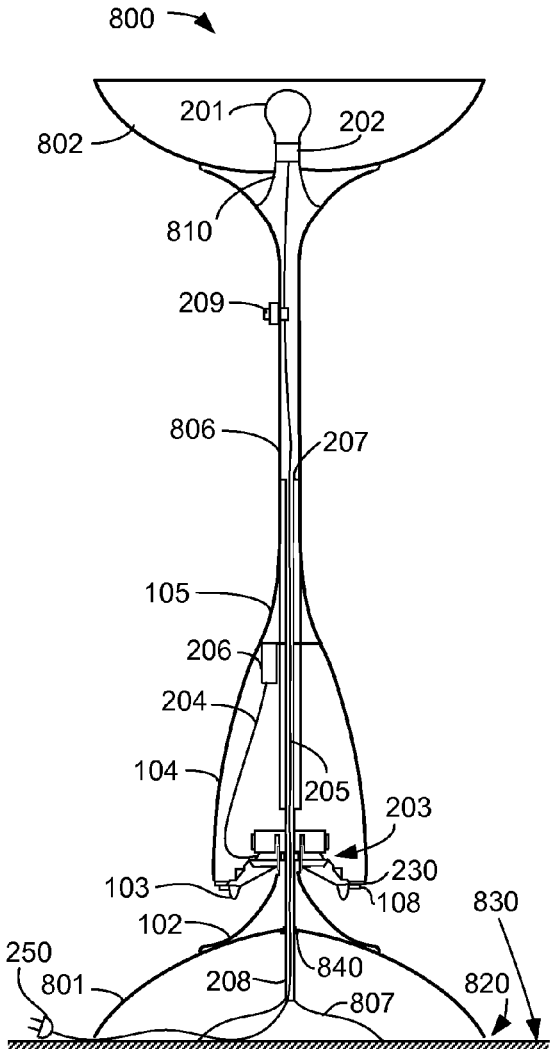
FIG. 8B is a sectional view illustrating the second exemplary embodiment of an omni-directional speaker lamp of FIG. 8A, configured as an inverted omni-directional speaker lamp.

FIG. 8B is a sectional view through section B-B' of FIG. 8A illustrating the second exemplary embodiment of the omni-directional speaker lamp configured as an inverted omni-directional speaker lamp 800 of FIG. 8A. In this embodiment, the speaker 203 is preferably downward facing and the lamp (202 and 201) is not. Rather, the lamp (202 and 201) is within lampshade 802 and is supported by lamp support 810 coupled to lamp support pole 806. Electrical power wires 205 connect electrical plug 250 to light bulb 201 through rod 208, connector 207, and lamp support pole 806, including switch 209, as shown. In the illustrated embodiment, rod 208 extends downward from speaker 203 in speaker lamp 800 to engage inner foot 807 to provide support and to relieve the mechanical load on second sound dispersion element 801. Rod 208 also couples to connector 207 to link mechanical support from the inner foot 807 to the lamp support pole 806. Wireless audio signal receiver 206 is coupled to speaker 203 via speaker wires 204, which supply an audio signal to the speaker 203. This design may be especially suitable for subwoofer speakers. Inverted omni-directional speaker lamp 800 is one example of the wide variety of design comprehended by the present disclosure. In another embodiment, a second speaker 203 is installed adjacent the lamp in addition to the speaker 203 adjacent the floor 830. In yet another particular embodiment, the lamp (202 and 201) is omitted to create an omni-directional speaker.

Figure 9A:
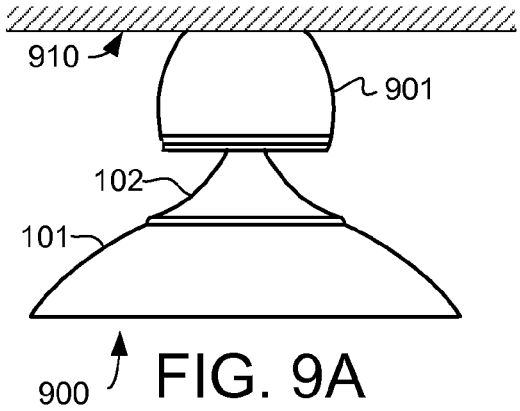
FIG. 9A is a side view illustrating a third exemplary embodiment of an omni-directional speaker lamp adapted to be attached to a ceiling or similar surface and configured as a compact omni-directional speaker lamp.
Figure 9B:
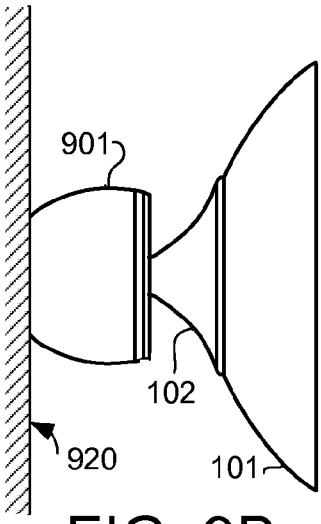
FIG. 9B is a side view illustrating the third exemplary embodiment of the omni-directional speaker lamp of FIG. 9A adapted to be attached to a wall or similar surface and configured as a compact omni-directional speaker lamp.
Figure 9C:
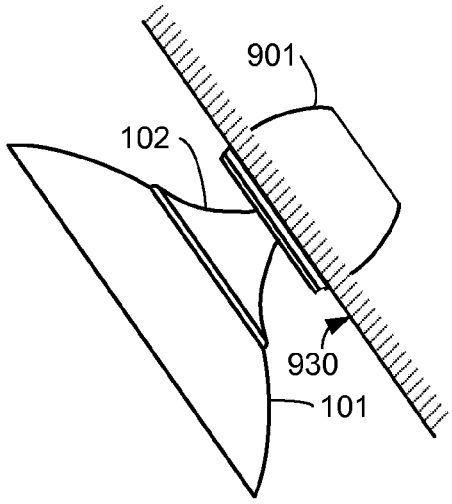
FIG. 9C is a side view illustrating the third exemplary embodiment of the omni-directional speaker lamp of FIG. 9A adapted to be attached and countersunk into to an inclined surface and configured as a compact omni-directional speaker lamp.
Figure 9D:
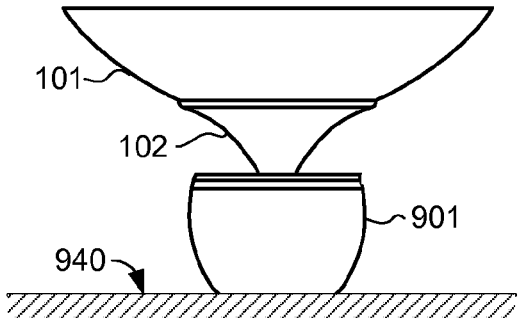
FIG. 9D is a side view illustrating the third exemplary embodiment of the omni-directional speaker lamp of FIG. 9A adapted to be supported by a floor, desk, or similar horizontal surface and configured as a compact omni-directional speaker lamp.

FIG. 9A is a side view illustrating a third exemplary embodiment of an omni-directional speaker lamp adapted to be attached to a ceiling or similar environmental surface 910 and configured as a compact omni-directional speaker lamp 900. The speaker 203 (not shown) is housed, along with associated electronics, in support structure 901, which is similar in function to support structure 104. The relationship of the speaker 203, first sound dispersion element 102, second sound dispersion element 101, and the electrical socket 202 (not shown in FIG. 9A) may be substantially the same as for omni-directional speaker lamp 100. Attachment to the underside of a horizontal environmental surface may be by bracket means. If the surface 910 is a ceiling, external wiring may be routed above the ceiling. FIG. 9B is a side view illustrating the third exemplary embodiment of the compact omni-directional speaker lamp 900 of FIG. 9A adapted to be attached to a wall or similar vertical environmental surface 920. FIG. 9C is a side view illustrating the third exemplary embodiment of the compact omni-directional speaker lamp 900 of FIG. 9A adapted to be attached and countersunk into to an inclined surface 930. FIG. 9D is a side view illustrating the third exemplary embodiment of the compact omni-directional speaker lamp 900 of FIG. 9A adapted to be supported by a floor, desk, or similar horizontal environmental surface 940. In an alternate embodiment, the lamp may be omitted, but a flanged sleeve 320 coupled to rod 208 for securing second sound dispersion element 101 is still required. This embodiment and its applications further illustrate, without limitation, further variations in the design of the disclosed compact omni-directional speaker lamp 900. In an alternate embodiment, the electrical light socket 202 is omitted to create an omni-directional speaker.

Figure 10:
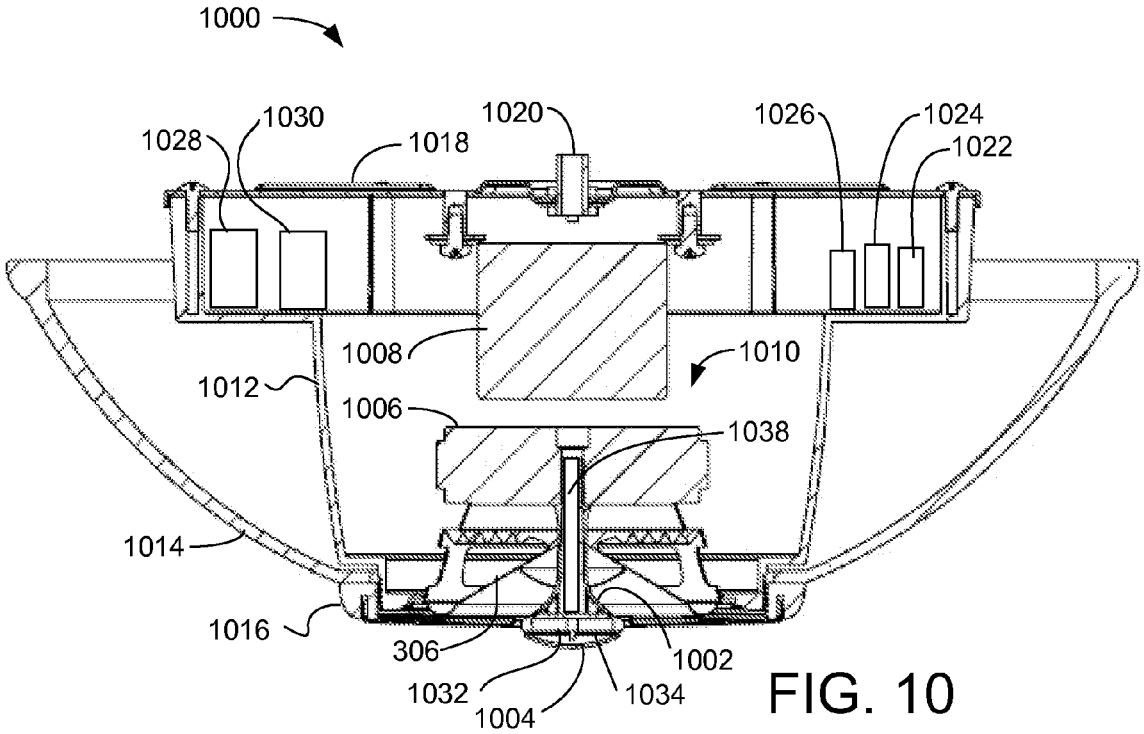
FIG. 10 is a cross-sectional elevation view illustrating the fourth exemplary embodiment of the omni-directional speaker lamp adapted to be coupled to a ceiling fan, according to an embodiment of the present invention.

FIG. 10 is a cross-sectional elevation view illustrating the fourth exemplary embodiment of the omni-directional speaker lamp 1000 adapted to be coupled to a ceiling fan, according to an embodiment of the present invention. Omni-directional speaker lamp 1000 comprises a housing 1012 having a generally frustro-conical portion and an upper, generally cylindrical portion. The housing 1012 is a support structure for a speaker 1010 which has a pole piece 1006 and a primary magnet 1008. The magnet 1008 is suspended from a fan interface panel 1018 which substantially closes the top of the housing 1012. A coupling 1020, for coupling the omni-directional speaker lamp 1000 to a ceiling fan or a bracket on an environmental surface, extends from the fan interface panel 1018. The omni-directional speaker lamp 1000 has a lampshade 1014, which is secured to the housing 1012 using ring 1016. Lampshade 1014 may be of various functional and decorative shapes, may be transparent or translucent, and may bear designs by various means.

Sound diffuser 1002 extends from the center of the speaker 1010, preferably from the pole piece 1006, as with the embodiments previously described. The rod 1038 (like rod 208) supports and secures a circuit board at the distal end of the sound diffuser 1002. The circuit board supports a combined LED display and an IR receiver 1034 for assisting in remotely controlling the audio functions of the speaker 1010, such as volume, wireless channel, and sound balance. The diffuser circuit board may also support at least a portion of a wireless audio signal receiver 1032 (such as an antenna). The circuit board is covered by an IR-transparent cover 1004, which is preferably substantially opaque to room lighting but not to the LED display.

Light sockets 1113, secured to the housing 1012, may be of various known configurations. Lights 1102 may not be included at point of sale.

Figure 11:
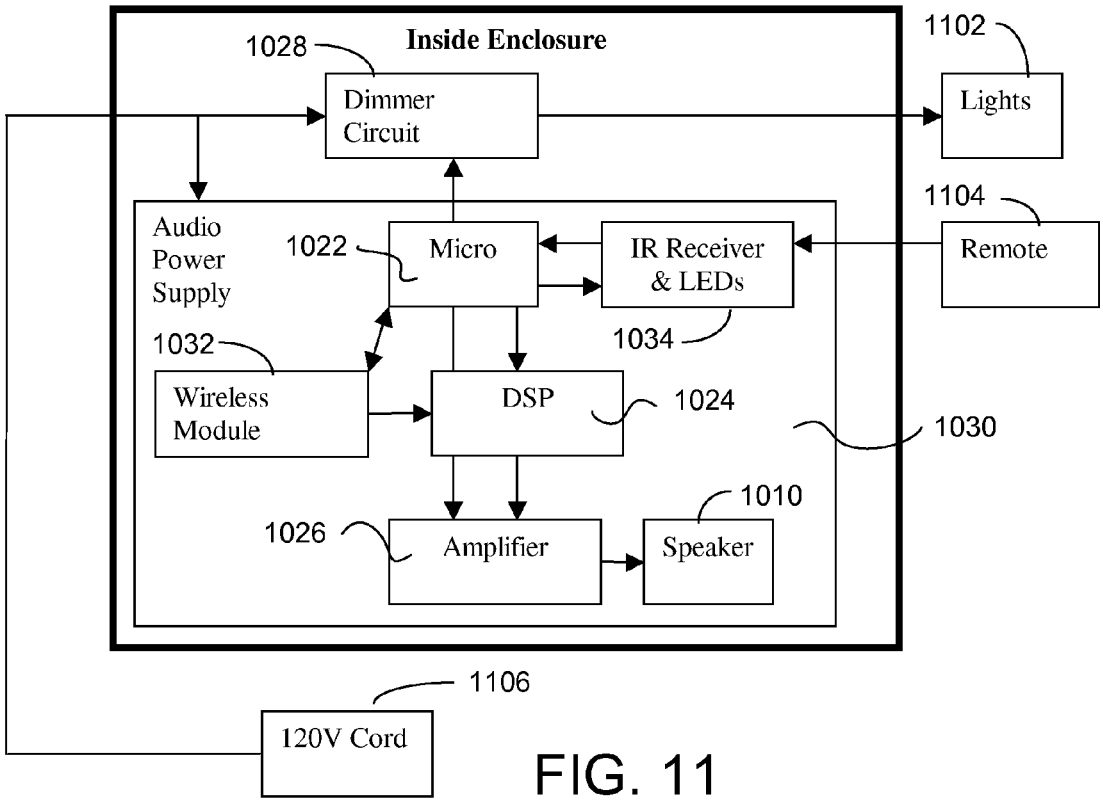
FIG. 11 is a block diagram of the audio system and interfaces of the fourth exemplary embodiment of the omni-directional speaker lamp adapted to be coupled to a ceiling fan of FIG. 10, according to an embodiment of the present invention.

FIG. 11 is a block diagram of the audio system and interfaces of the fourth exemplary embodiment of the omni-directional speaker lamp 1000 of FIG. 10 adapted to be coupled to a ceiling fan, according to an embodiment of the present invention. Power is brought in the ceiling fan on a 120-volt cord 1106 as is known in the art of attaching lamps to ceiling fans. The 120 volts may optionally pass through light controller 1028, such as a dimmer circuit, on its way to the light sockets 1113. The 120-volt cord 1106 also supplies the audio power supply 1030, which supplies appropriate voltages to all other elements of the audio system.

Wireless receiver 1032 receives a wireless audio signal from a wireless audio transmitter that is coupled to the audio output of an audio device, such as a stereo. Wireless module supplies the audio signal to the digital signal processor 1024 which supplies the amplifier 1026. The amplifier 1026, in turn, supplies the speaker 1010. Wireless receiver 1032 receives channel selection inputs from micro controller 1022 and returns the currently selected channel through the micro controller 1022 to the LEDs 1034 for display. The LEDs 1034 may display a channel number. In an alternate embodiment, an association between channel number and audio source may be stored in a memory associated with micro controller 1022, such as associating channel two with a stereo and channel three with a television set. When channel two is selected, the LEDs 1034 may display "STEREO" and when channel three is selected the LEDs 1034 may display "TV", for example. The micro controller 1022 may be used as an interface to send dimmer control signals that originate in the remote controller 1104, are received by the IR receiver 1034, and are supplied to the dimmer circuit 1028 through the micro controller 1022. Thus, the remote controller 1104 can be used to control the brightness of the lights 1102. The micro controller 1022 may also send signals to the digital signal processor 1024 to control equalization and reverberation.

Figure 12:
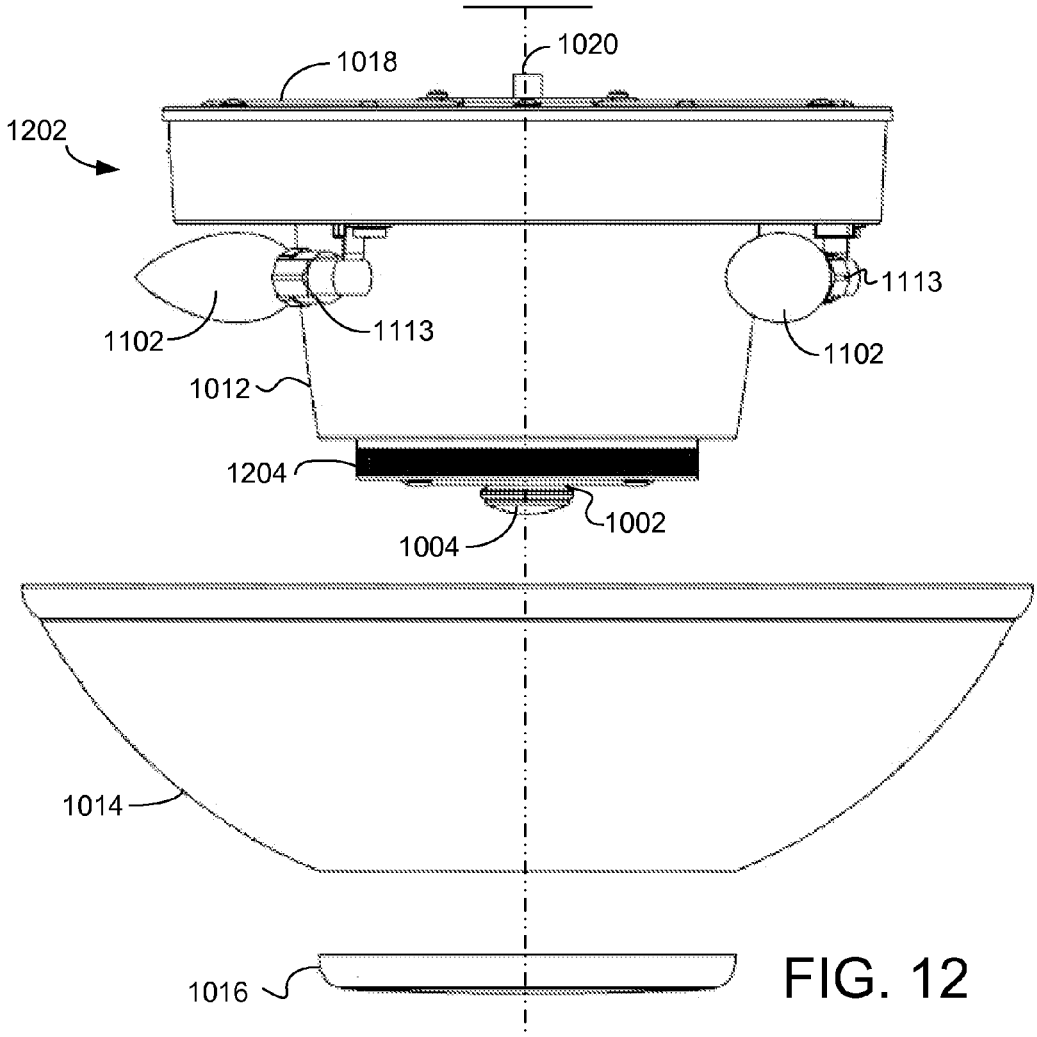
FIG. 12 is an exploded side elevation view illustrating an assembly step of the fourth exemplary embodiment of the omni-directional speaker lamp adapted to be coupled to a ceiling fan of FIG. 10, according to an embodiment of the present invention.

FIG. 12 is an exploded side elevation view illustrating an assembly step of the fourth exemplary embodiment of the omni-directional speaker lamp 1000 of FIG. 10 adapted to be coupled to a ceiling fan, according to an embodiment of the present invention. The assembled housing 1012, fan interface panel 1018, lights 1102, speaker 1010, sound diffuser 1002 and cover 1004 form the core 1202 of the omni-directional speaker lamp 1000. The lower portion of the housing has a threaded portion 1204. Lampshade 1014 is secured to the lower portion of housing 1012 using ring 1016, which has internal threads which are complimentary to threaded portion 1204.

Figure 13:
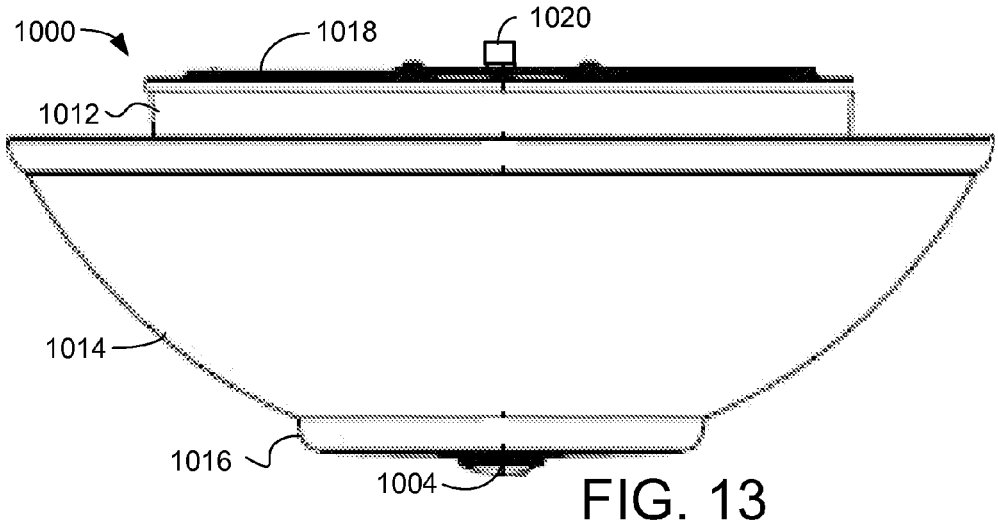
FIG. 13 is a side elevation view illustrating the fourth exemplary embodiment of the omni-directional speaker lamp adapted to be coupled to a ceiling fan of FIG. 10, according to an embodiment of the present invention.

FIG. 13 is a side elevation view illustrating the fourth exemplary embodiment of the omni-directional speaker lamp 1000 of FIG. 10 adapted to be coupled to a ceiling fan, according to an embodiment of the present invention. Shown assembled, coupling 1020 may now be used to install the omni-directional speaker lamp 1000 to a ceiling fan. The omni-directional speaker lamp 1000 may be packaged and sold as in FIG. 12 or FIG. 13 lampshade 1014 should not extend upward to a point where in would impinge upon the fan blades, once installed.

Figure 14A:
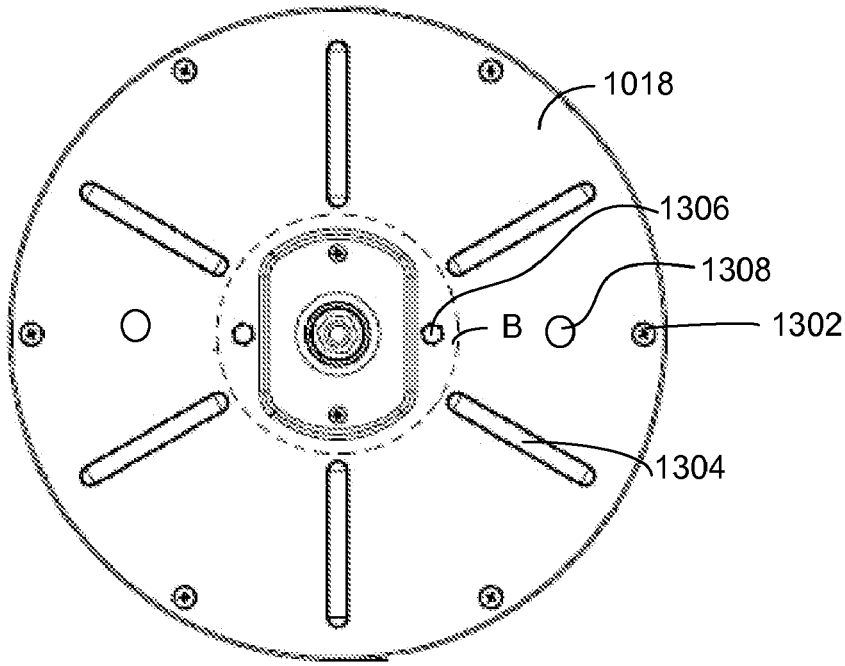
FIG. 14A is a top plan view illustrating an exemplary fan interface panel of the fourth exemplary embodiment of the omni-directional speaker lamp adapted to be coupled to a ceiling fan of FIG. 10 and showing detail B, according to an embodiment of the present invention.

FIG. 14A is a top plan view illustrating an exemplary fan interface panel 1018 of the fourth exemplary embodiment of the omni-directional speaker lamp 1000 of FIG. 10 adapted to be coupled to a ceiling fan and showing detail B, according to an embodiment of the present invention. Screws 1302 secure fan interface panel to housing 1012. Ribs 1304 increase the structural strength of the fan interface panel 1018. Detail B illustrates an interface for a particular ceiling fan. Bolt holes 1306 are used to secure the primary magnet 1008. Openings 1308 are power conduits allowing a 120-volt cord 1106 from the ceiling fan to enter the housing 1012.

Figure 14B:
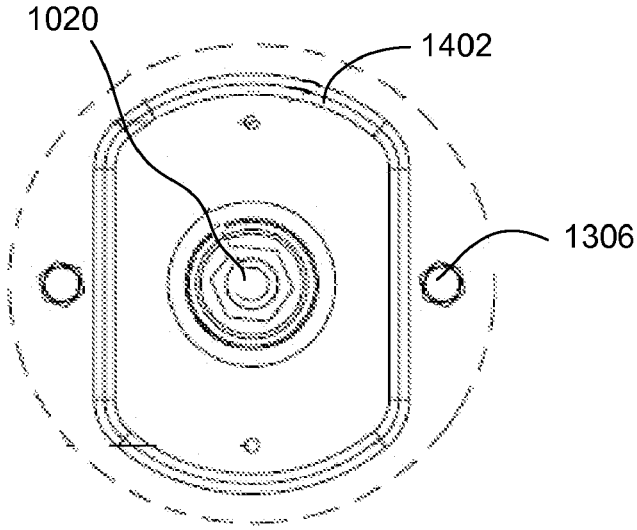
FIG. 14B is an illustration of detail B of FIG. 14A of the exemplary fan interface panel of the fourth exemplary embodiment of the omni-directional speaker lamp adapted to be coupled to a ceiling fan of FIG. 10, according to an embodiment of the present invention.

FIG. 14B is an illustration of detail B of FIG. 14A of the exemplary fan interface panel 1018 of the fourth exemplary embodiment of the omni-directional speaker lamp 1000 of FIG. 10 adapted to be coupled to a ceiling fan, according to an embodiment of the present invention. Raised portion 1402 has an outer ridge and an inner, higher ridge, sized and shaped to be received by a particular model of ceiling fan. The concentric arrangement aides in seating the fan interface panel 1018 in a complimentary recess on the ceiling fan.

Figure 15A:
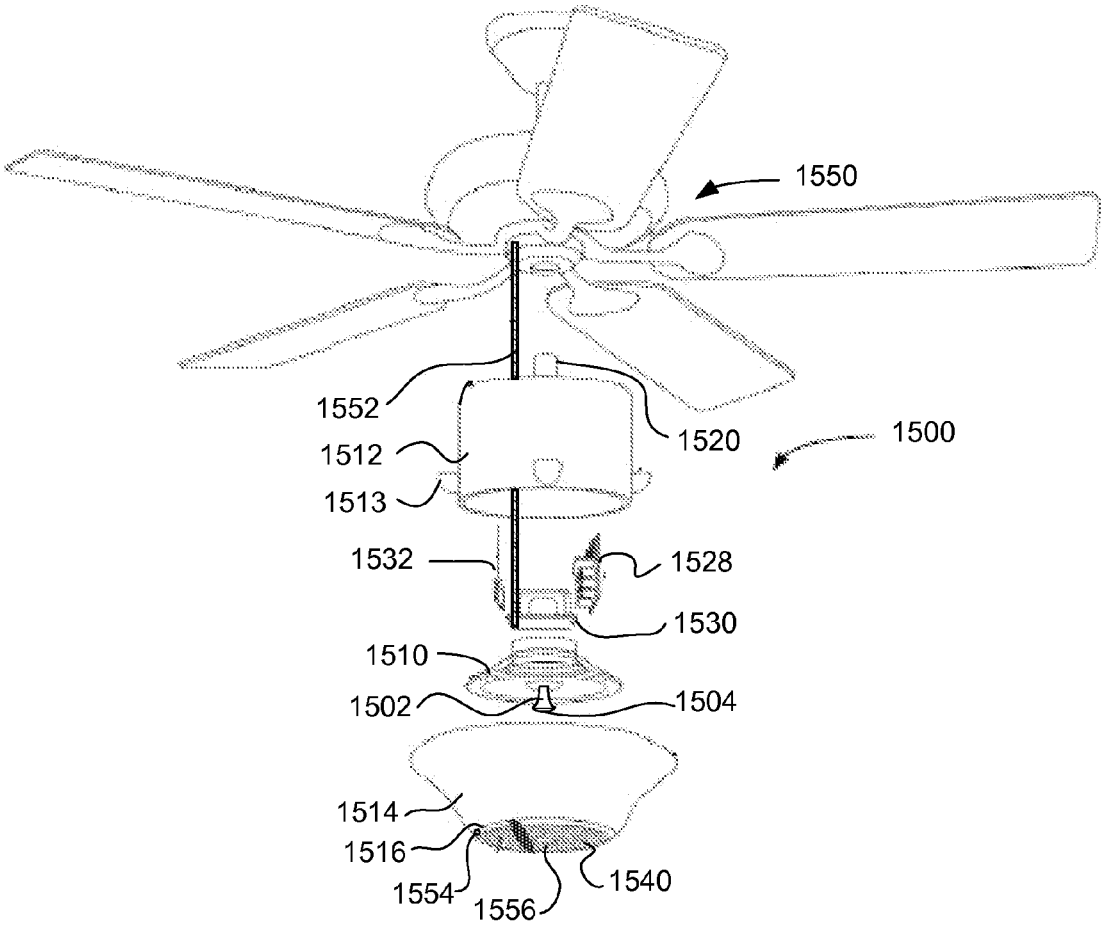
FIG. 15A is an exploded perspective view illustrating an exemplary fifth embodiment of an omni-directional speaker lamp, according to an embodiment of the present invention.

FIG. 15A is an exploded perspective view illustrating an exemplary fifth embodiment of an omni-directional speaker lamp 1500, according to an embodiment of the present invention. Speaker 1510 has a sound diffuser 1502 that has a cover 1504. An IR receiver 1534 and an LED display 1535 (see FIG. 15B) are positioned in the sound diffuser 1502 under cover 1504 which is substantially transparent to the IR wavelength of a remote control unit, such as remote control unit 1104. The LED display 1535 may indicate, for example, aspects of the state of the omni-directional speaker lamp 1500 such as the volume and the selected channel for wireless audio signal receiver 1532.

Speaker 1510 is supplied with an audio signal received by wireless audio receiver 1532 and amplified in an amplifier, such as amplifier 1026 mounted on audio control board 1528. The wireless audio receiver 1532 and the audio control board 1528 are powered by power supply 1530, which receives power from line voltage supplied from ceiling fan 1550.

Housing 1512 supports light sockets 1513 and coupling 1520, for coupling to the ceiling fan 1550. Control chain 1552, for turning the fan on, off, or changing its speed, is threaded through the housing 1512, past the speaker 1510, and through opening 1554 in ring 1516, allowing pull-chain control of the fan, with the speaker 1510 in place. The speaker grill 1540 has an opening 1556 to receive sound diffuser 1502, such that cover 1504 protrudes outside of the speaker grill 1540 to receive signals from an IR remote. Speaker grill 1540 is preferably part of ring 1516, which secures lampshade 1514 to housing, or support structure, 1512.

Figure 15B:
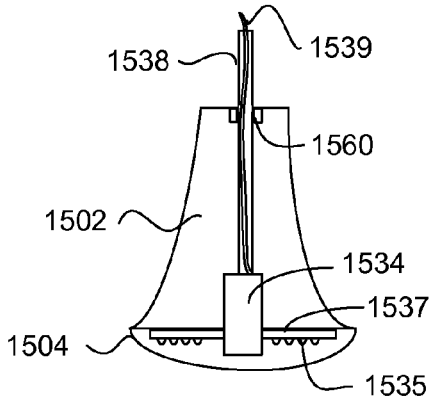
FIG. 15B is a diagrammatic cross-sectional view illustrating the exemplary sound diffuser of the exemplary fifth embodiment of the omni-directional speaker lamp of FIG. 15A, according to an embodiment of the present invention.

FIG. 15B is a diagrammatic cross-sectional view illustrating the exemplary sound diffuser 1502 of the exemplary fifth embodiment of the omni-directional speaker lamp 1500 of FIG. 15A, according to the fifth exemplary embodiment of the present invention. Sound diffuser 1502 with cover 1504 is preferably supported by connection to the speaker 1510 in a manner similar to the support of sound diffuser 102 as discussed above regarding FIG. 3. Threaded rod 1538 extends through sound diffuser 1502 which, in turn, extends through a central opening of the diaphragm of speaker 1510. Securer 1560 engages threaded rod 1538 to secure the sound diffuser 1502 to a pole piece of the speaker magnet as in FIG. 3. Threaded rod 1538 supports a small circuit board 1537 that supports LED display 1535 and IR receiver 1534 inside sound diffuser 1502 and under cover 1504. Control leads 1539 provide a signal path and power between the IR receiver 1534 and the audio control board 1528, as well as signal path and power between the LED display 1535 and audio control board 1528. In a particular embodiment, the LED display 1535 may be one or more digital alphanumeric LED displays 1535, as are known in the art. Control leads 1539 thread through a longitudinal bore through rod 1538.

Figure 16:
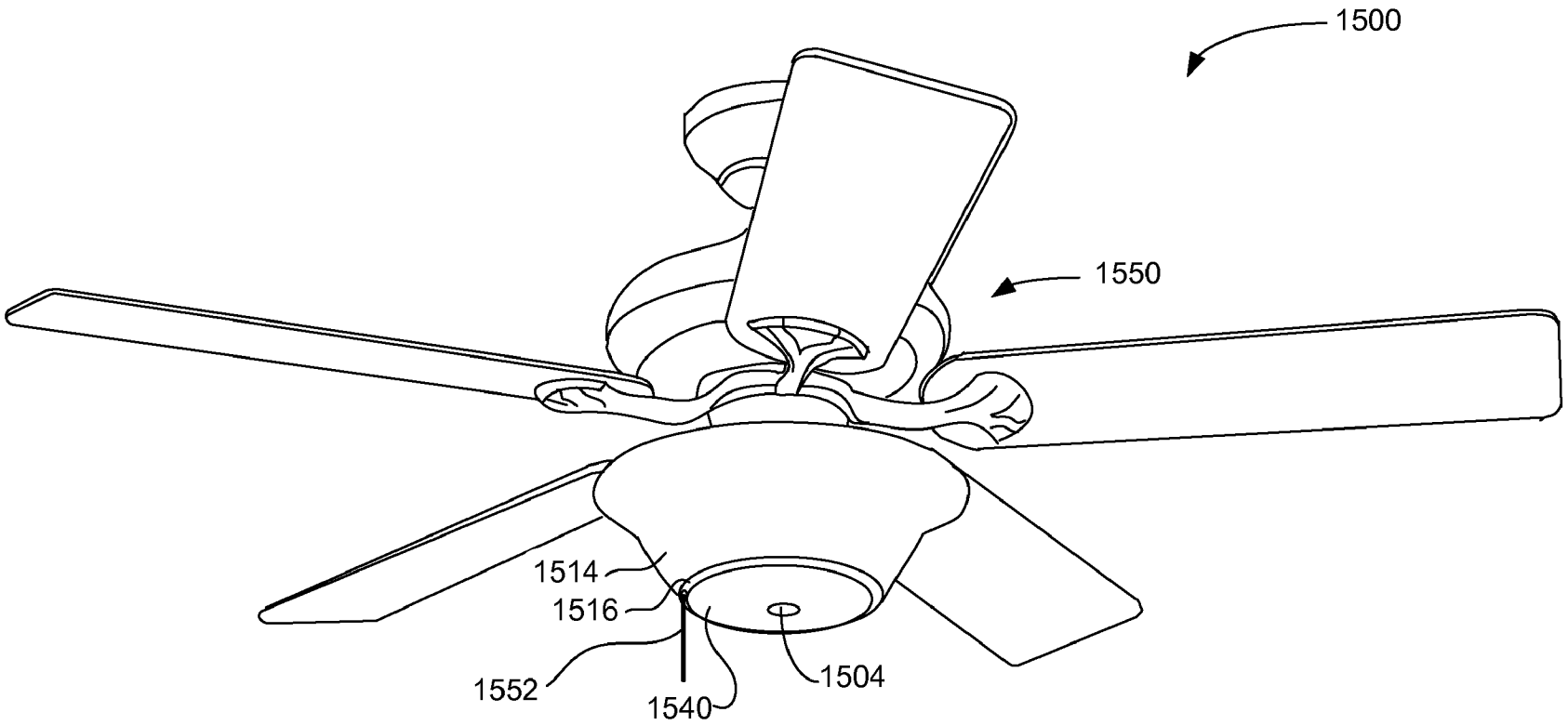
FIG. 16 is a lower front perspective view illustrating the alternate embodiment of an omni-directional speaker lamp of FIG. 15A, according to an embodiment of the present invention.

FIG. 16 is a lower front perspective view illustrating the exemplary omni-directional speaker lamp 1500 of FIG. 15A installed on a ceiling fan 1550, according to the fifth exemplary embodiment of the present invention. From outward appearances, the omni-directional speaker lamp 1500 looks like a normal light fixture for a ceiling fan 1550, except for the speaker grill 1540 and the cover 1504. Rim 1516 includes an opening 1554 through which fan chain 1552 is threaded. Considerable variation in the design of lampshade 1514 as to shape, size, color, or graphic design is expected within the scope of the present invention. Likewise, various ceiling fans 1550 may support the omni-directional speaker lamp 1500.

Figure 17:
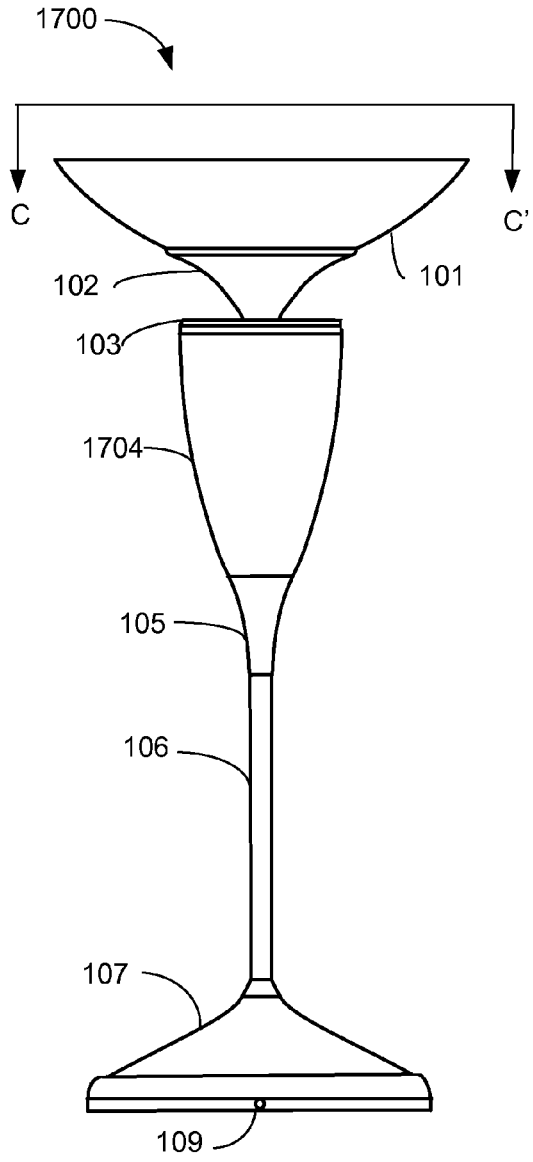
FIG. 17 is an elevation view illustrating an exemplary sixth embodiment of a wireless omni-directional speaker lamp defining section C-C', according to an embodiment of the present invention.

FIG. 17 is an elevation view illustrating a sixth embodiment of a wireless omni-directional speaker lamp 1700 defining section C-C', according to an exemplary embodiment of the present invention. While the audio signal may be wirelessly transmitted in both embodiments 100 and 1700, the control of volume, wireless audio channel, light brightness, and other audio signal processing functions may be wirelessly controlled through an IR receiver on a control board 1812 (see FIG. 18). Support structure 1704 is preferably made of an IR-transparent material to facilitate IR signal access to IR receiver 1812. In an alternate embodiment, support structure 1704 may have an IR-transparent window. The wireless omni-directional speaker lamp 1700, may omit manual control panel 110, as shown, or may retain it as a backup. The wireless omni-directional speaker lamp 1700 is otherwise similar to the wireless omni-directional speaker lamp 100, as indicated by the similar reference numbers.

Figure 18:
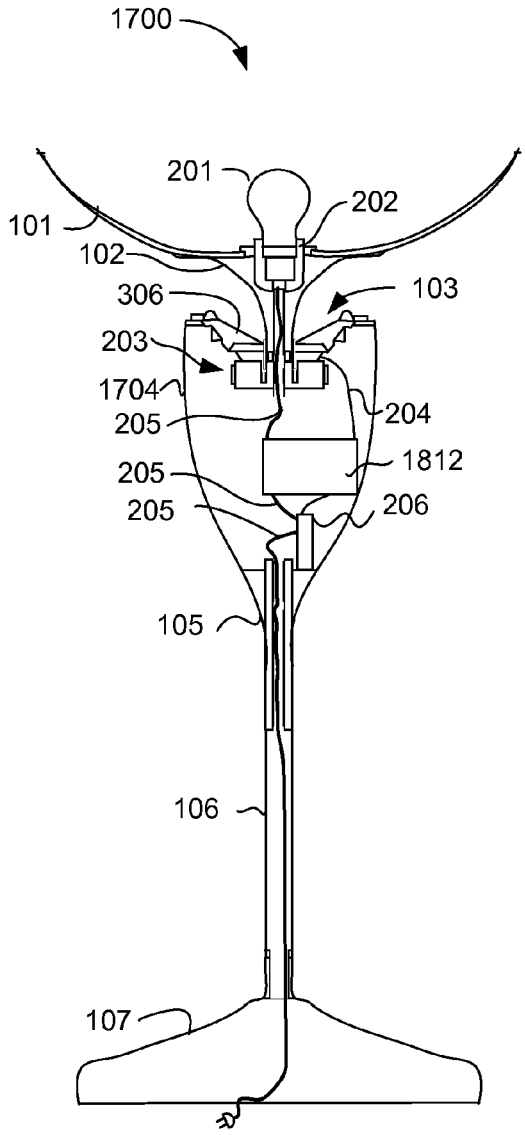
FIG. 18 is a cross-sectional elevation view illustrating the wireless omni-directional speaker lamp of FIG. 17 through section C-C', according to an embodiment of the present invention.

FIG. 18 is a cross-sectional elevation view illustrating the wireless omni-directional speaker lamp 1700 of FIG. 17 through section C-C', according to an exemplary embodiment of the present invention. Control board 1812 includes an IR receiver, and is shown within support structure 1704, but may be placed within wireless omni-directional speaker lamp 1700 as desired, consistent with size requirements and IR signal access. In a particular embodiment, the IR receiver may be a discrete part, coupled to the control board 1812 by wires. Control board 1812 receives an IR signal from a remote control 1104, processes the IR signal and actuates the command contained in the IR signal.

First sound diffusion element 102, sound diffuser 1002, and sound diffuser 1502 have equivalent functionality. Common to all embodiments, a rod 208, 1038, or 1538 extends from the pole piece 301, 1006, and the similar pole piece within speaker 1510, within the sound dispersion element 102, 1002, or 1502, respectively, to support objects 202 and 807; 1032 and 1034; as well as 1534, 1535, and 1537, respectively, at a point 370 beyond the diaphragm 306. In a particular embodiment, the omni-directional speaker lamp 1000 and ceiling fan 1550 may be produced and sold a single integral unit, as may omni-directional speaker lamp 1500.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. For example, the rod 208 might be used as a conduit for water or other fluid to supply a fountain or other fluidic appliance in an extension of the disclosure. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A speaker, having a diaphragm with a central opening and further having at least one pole piece, the speaker comprising:

a) at least one first sound dispersion element extending from such at least one pole piece through such central opening of such diaphragm and further extending beyond such diaphragm;

b) at least one rod coupled to such at least one pole piece and extending, within said at least one sound dispersion element, through such central opening of such diaphragm to at least one point beyond at least a portion of such diaphragm, c) wherein said at least one rod is operable to at least assist in supporting at least one object, other than said at least one first sound dispersion element, adjacent said at least one point beyond said diaphragm; and d) at least one coupling operable to secure and support at least one of an electrical light socket and a circuit board on said rod in at least one spaced-apart relationship with such at least one pole piece.

2. The speaker of claim 1, wherein said at least one object comprises at least one second sound dispersion element and wherein said at least one second sound dispersion element at least one of abuts to and extends from said at least one first sound dispersion element.

3. The speaker of claim 1, wherein said at least one object comprises at least one of:

a) an IR receiver;

b) a light socket;

c) an LED display; and d) at least a portion of a wireless audio receiver.

4. The speaker of claim 1, further comprising at least one support structure adapted to support said speaker in at least one spaced-apart relationship with at least one of:

a) an environmental surface; and b) a ceiling fan.

5. The speaker of claim 1, integrated into at least one of:

a) an omni-directional speaker lamp;

b) an inverted omni-directional speaker lamp;

c) a wireless omni-directional speaker lamp;

d) a wireless omni-directional speaker lamp adapted to be coupled to a ceiling fan; and e) a compact omni-directional speaker lamp.

6. The speaker of claim 1, wherein said at least one first sound dispersion element comprises at least one larger transverse perimeter distal said at least one pole piece than proximal said at least one pole piece.

7. The speaker of claim 1, wherein said at least one first sound dispersion element is operable to disperse sound unobstructed by structural members located radially external to said at least one first sound dispersion element.

8. The speaker of claim 1, wherein said at least one pole piece comprises at least one axial threaded bore and said at least one rod comprises external threads and at least one longitudinal bore and is secured in said at least one axial threaded bore, said at least one externally threaded rod operable to serve as:

a) at least a portion of said at least one coupling operable to receive at least one securer operable to secure said at least one first sound dispersion element to said at least one pole piece;

b) at least a portion of said at least one coupling operable to secure and support at least one of an electrical light socket and a circuit board in at least one spaced-apart relationship with said at least one pole piece; and c) at least one conduit for at least one electrical power conductor.

9. The speaker of claim 1, further comprising at least one wireless audio signal receiver.

10. A speaker having at least one diaphragm having an axis of radial symmetry, at least one central opening, and at least one pole piece proximate such central opening, such pole piece having at least one bore there through, wherein such at least one bore is axially aligned to such central opening in such at least one diaphragm, the speaker further comprising:

a) at least one first sound dispersion element extending from proximate such at least one pole piece through such at least one central opening of such at least one diaphragm, i) wherein said at least one first sound dispersion element has at least one proximal end proximate to such at least one pole piece and at least one distal end distal to such at least one pole piece, and ii) wherein said at least one first sound dispersion element comprises at least one web defined by at least one longitudinal axis aligned parallel to the axis of radial symmetry of such at least one diaphragm, said web comprising at least one larger transverse perimeter at said distal end and comprising at least one smaller transverse perimeter at said proximal end;

b) said at least one first sound dispersion element operable to create at least one sound path generally transverse to the axis of radial symmetry of such at least one diaphragm in an arc of 360 degrees, c) wherein said at least one first sound dispersion element is operable to disperse sound unobstructed by structural members located radially external to said at least one first sound dispersion element; and d) at least one rod coupled to such at least one pole piece and extending, within said at least one first sound dispersion element, through such central opening of such diaphragm to at least one point beyond such diaphragm, e) wherein said at least one rod is operable to at least assist in supporting at least one object, other than said at least one first sound dispersion element, at least one point beyond such diaphragm; and f) at least one rod coupling operable to secure and support at least one of an electrical light socket and a circuit board on said rod in at least one spaced-apart relationship with such at least one pole piece.

11. The speaker of claim 10, wherein said at least one object comprises at least one of:

a) an JR receiver;

b) a light socket;

c) an LED display; and d) at least a portion of a wireless audio receiver.

12. The speaker of claim 11, wherein said first dispersion element supports a cover for said at least one of:

a) an JR receiver;

b) an LED display; and c) at least a portion of a wireless audio receiver.

13. The speaker of claim 10, further comprising a housing for said speaker, said housing comprising at least one speaker coupling for coupling said speaker to one of:

a) an environmental surface; and b) a ceiling fan.

14. The speaker of claim 13, wherein said at least one speaker coupling is further operable to be coupled to a bracket on an environmental surface.

15. The speaker of claim 13, wherein said housing further comprises a housing for at least one of:

a) an audio power supply;

b) an audio amplifier;

c) a micro controller;

d) a digital signal processor; and e) a dimmer circuit.

16. The speaker of claim 15, wherein said housing further comprises a housing for at least a portion of a wireless audio receiver.

17. The speaker of claim 13, further comprising at least one electrical light socket structured and arranged to be secured to one of:

a) said at least one rod; and b) said housing.

18. The speaker of claim 13, wherein said at least one object comprises at least one second sound dispersion element, wherein said at least one second sound dispersion element at least one of abuts to and extends from said at least one first sound dispersion element.

19. The speaker of claim 10, further comprising a ceiling fan that is one of coupled to and integrated with said speaker.

20. A speaker, having a diaphragm with a central opening and a pole piece having an axial threaded bore through such pole piece, the speaker further comprising:

a) at least one first sound dispersion element extending from such pole piece through such central opening of such diaphragm and further extending beyond such diaphragm;

b) wherein said at least one first sound dispersion element comprises at least one web having at least one larger transverse perimeter distal such pole piece than proximal such pole piece and further comprises at least one internal transverse flange proximate such pole piece;

c) at least one externally threaded rod threaded partially into such axial threaded bore and extending within said at least one web and further extending to at least one point beyond such diaphragm;

d) at least one rod coupling operable to secure and support at least one of an electrical light socket and a circuit board on said rod in at least one spaced-apart relationship with such at least one pole piece;

e) at least one support structure structured and arranged to support said speaker in at least one particular orientation;

f) at least one support member configured to support the speaker in a spaced apart relation to at least one of:

i) an environmental surface; and ii) a ceiling fan;

g) at least one audio signal receiver structured and arranged to supply at least one audio signal to such speaker;

h) at least one electrical power wire structured and arranged to supply electrical current to said at least one electrical device; and i) at least one remotely controllable electrical device.

* * * * *